US005645218A

United States Patent [19]

Heren et al.

[11] Patent Number: 5,645,218

[45] Date of Patent: Jul. 8, 1997

[54] UNITIZED SPRINKLER ASSEMBLY WITH ADJUSTABLE WATER CONTROL MECHANISM

[75] Inventors: Lawrence P. Heren; Jerry R. Hayes, both of East Peoria, Ill.; Thomas R. Kruer, Edgewood, Ky.

[73] Assignee: L. R. Nelson Corporation, Peoria, Ill.

[21] Appl. No.: 451,828

[22] Filed: May 26, 1995

Related U.S. Application Data

[63] Continuation-in-part of Ser. No. 252,555, Jun. 1, 1994, Pat. No. 5,511,727.

[51] Int. Cl.[6] ..... B05B 3/16

[52] U.S. Cl. ..... 239/242; 239/263.3; 239/DIG. 1

[58] Field of Search ..... 239/237, 240, 239/242, 263.3, DIG. 1

[56] References Cited

U.S. PATENT DOCUMENTS

| | | | |
|---|---|---|---|
| 615,486 | 12/1898 | Jendis | 239/566 X |
| 1,517,664 | 12/1924 | Bergquist | 239/242 |
| 3,423,024 | 1/1969 | Morawetz | 239/242 |
| 3,434,522 | 3/1969 | Laurenty | 239/566 X |
| 3,567,122 | 3/1971 | Congdon et al. | 239/69 |
| 3,599,877 | 8/1971 | Goldschmied | 239/566 X |
| 3,647,140 | 3/1972 | Perrot et al. | 239/242 |
| 3,827,637 | 8/1974 | Stephany et al. | 239/242 |
| 4,335,852 | 6/1982 | Chow | 239/68 |
| 4,632,313 | 12/1986 | Rinkewich | 239/242 |
| 4,721,248 | 1/1988 | Chow | 239/242 |
| 5,052,621 | 10/1991 | Katzer et al. | 239/242 |
| 5,052,622 | 10/1991 | Lindermeir et al. | 239/242 |
| 5,098,020 | 3/1992 | Cooper et al. | 239/242 X |
| 5,174,501 | 12/1992 | Hadar | 239/242 X |
| 5,305,956 | 4/1994 | Wang | 239/DIG. 1 X |
| 5,330,103 | 7/1994 | Eckstein | 239/242 |
| 5,335,855 | 8/1994 | Borod | 239/566 X |
| 5,350,115 | 9/1994 | Burnworth et al. | 239/DIG. 1 X |

FOREIGN PATENT DOCUMENTS

| | | | |
|---|---|---|---|
| 47444 | 3/1982 | European Pat. Off. | 239/242 |
| 2135012 | 12/1972 | France . | |
| 536769 | 10/1931 | Germany . | |
| 2444664 | 9/1974 | Germany . | |

*Primary Examiner*—Lesley D. Morris
*Attorney, Agent, or Firm*—Mayer, Brown & Platt

[57] ABSTRACT

Unitized sprinkler assembly including a housing assembly having an inlet end constructed and arranged to be connected with a source of water under pressure and a spaced outlet end, a manually adjustable control mechanism carried by the housing assembly, a sprinkler head assembly having an inlet end disposed to receive water under pressure flowing from the outlet end of the housing assembly, a base assembly constructed and arranged to support the assemblies on a ground area to be sprinkled, a structural connection between the sprinkler head assembly and the housing assembly constructed and arranged to enable the sprinkler head assembly to oscillate about an oscillatory axis with respect to the housing assembly, an oscillating mechanism mounted in the housing assembly constructed and arranged to be operated by the flow of water under pressure and connected with the sprinkler head assembly to oscillate the sprinkler head assembly about the oscillatory axis through repeated oscillating head cycles, an adjusting mechanism constructed and arranged to enable the distance of the head stroke of each oscillating head cycle to be adjusted within a range between a minimum head stroke distance and a maximum head stroke distance, and a control member to control selectively the width of the spray patter discharged from the sprinkler head assembly. The housing assembly may include first and second housing assemblies.

54 Claims, 14 Drawing Sheets

UNITIZED SPRINKLER ASSEMBLY WITH ADJUSTABLE WATER CONTROL MECHANISM

This application is a continuation-in-part of U.S. application Ser. No. 08/252,555, filed Jun. 1, 1994 and now U.S. Pat. No. 5,511,727.

This invention relates to lawn sprinklers and more particularly to lawn sprinklers of the type having oscillating sprinkler head assemblies.

BACKGROUND OF THE INVENTION

Lawn sprinklers of the type having oscillating sprinkler head assemblies are well known. One well known type is the so-called wave type. Typically, the sprinkler head assembly of a wave type sprinkler assembly is constructed to discharge the water under pressure fed thereto in a fan-shaped multiple stream condition. The usual construction is an elongated tube bent into an upwardly extending arched configuration having a series of spaced discharge openings formed therein.

Another lawn sprinkler type having oscillating sprinkler head assemblies includes rotary sprinklers having a part circle capability. These include internally driven part circle rotary sprinklers. Typically, the sprinkler head assembly in the part circle rotary type sprinkler is constructed to discharge the water under pressure fed thereto in an upwardly and outwardly main stream and in many cases a secondary stream.

A characteristic of oscillating sprinkler head assemblies is that the water pattern distributed to the ground to be sprinkled is determined by the oscillating head cycle thereof. Each oscillating head cycle includes a head stroke in one direction and a return head stroke in the opposite direction so that a corresponding dimension of the water pattern corresponds with the distance of the head stroke of each oscillating head cycle. Thus, an advantage of oscillating type sprinkler assemblies is that a wide variation in the water pattern can be achieved by varying the head stroke of the oscillating head cycle.

It is also desirable to provide adjustable pattern sprinkler assemblies with other manually adjustable water control mechanisms to enhance their versatility. Such manually adjustable control mechanisms include mechanisms which operate to shut off the flow after a predetermined amount of water has been delivered based upon an adjustable manual setting and manually adjustable flow control mechanisms for varying the flow rate of the water delivered to and hence by the sprinkler head assembly based upon an adjustable manual setting.

BRIEF DESCRIPTION OF THE INVENTION

The present invention is based upon the underlying concept of unitizing the components of sprinkler assemblies of the type described so as to make it more cost effective to produce a line of different types of sprinkler assemblies with a variety of different manually adjustable control mechanisms and/or sprinkler head assemblies. Accordingly, it is an object of the present invention to provide a unitized sprinkler assembly embodying the aforesaid underlying concept.

In accordance with the principles of the present invention, this objective is obtained by providing a unitized sprinkler assembly comprising a first housing assembly having an inlet end constructed and arranged to be connected with a source of water under pressure and a spaced outlet end. A second housing assembly is provided having an inlet end and a spaced outlet end. The inlet end of the second housing assembly is constructed and arranged to mate with the outlet end of the first housing assembly and is connected in water pressure communicating relation therewith. A manually adjustable control mechanism is carried by the first housing assembly between the inlet end and outlet end thereof and is constructed and arranged to control the flow of water under pressure from the inlet end thereof to the outlet end thereof in accordance with the manual adjustment of the manually adjustable control mechanism. A sprinkler head assembly is provided which has an inlet end disposed to receive water under pressure flowing from the outlet end of the second housing assembly. A base assembly is provided which is constructed and arranged to support all of the assemblies on a ground area to be sprinkled and has the assemblies disposed in supported relation thereon. A structural connection is provided between the sprinkler head assembly and the second housing assembly constructed and arranged to enable the sprinkler head assembly to oscillate about an oscillatory axis with respect to the second housing assembly. An oscillating mechanism is mounted in the second housing assembly and is constructed and arranged to be operated by the flow of water under pressure between the inlet end and outlet end of the second housing assembly and connected with the sprinkler head assembly to oscillate the sprinkler head assembly about the oscillatory axis through repeated oscillating head cycles. The sprinkler head assembly is constructed and arranged to discharge water under pressure flowing through the inlet end thereof in a predetermined stream configuration so as to be distributed on the ground to be sprinkled in a predetermined water pattern determined by the oscillating head cycle thereof. Each of the oscillating head cycles includes a head stroke in one direction and a return head stroke in the opposite direction so that a corresponding dimension of the water pattern corresponds with the distance of the head stroke of each oscillating head cycle. An adjusting mechanism is provided which is constructed and arranged to enable the distance of the head stroke of each oscillating head cycle to be adjusted within a range between a minimum head stroke distance and a maximum head stroke distance so as to vary the corresponding dimension of the water pattern within a range between a minimum dimension and a maximum dimension.

In conjunction with the unitizing of the components of the lawn sprinkler assembly, improvements have been made in several of the unitized components or units of the sprinkler assembly. These improvements are particularly cost effective in the unitized lawn sprinkler assembly previously referred to but have applicability with and in other non-unitized sprinkler assemblies which utilize such components.

Accordingly, it is a further object of the present invention to provide a sprinkler assembly of the type described having an improved flow control mechanism. In accordance with the principles of the present invention, this objective is obtained by providing a sprinkler assembly comprising a housing assembly including an inlet end adapted to be communicated with a source of water under pressure and a spaced outlet end. A sprinkler head is connected in water pressure communicating relation with the housing assembly outlet end and is constructed and arranged to discharge water under pressure received from the housing assembly outlet end in a predetermined stream configuration therefrom. The housing assembly includes a peripheral wall portion extending axially between the inlet end and the outlet end of the housing assembly. The peripheral wall portion has a cam slot formed therein to extend from one end thereof peripherally to an opposite end thereof displaced axially from the one end thereof a distance substantially less than the peripheral distance between the ends thereof. The housing assembly inlet end communicates with an inlet cylindrical wall extending axially within an inlet end of the peripheral wall portion. The housing assembly outlet end communicates with an outlet cylindrical wall extending axially within an outlet end of the peripheral wall portion. A movable cylindrical wall is provided having opposite end portions disposed in sealed telescoping relation with the inlet and outlet cylindrical walls. A handle is fixed with respect to the movable cylindrical wall and extends within the cam slot outwardly thereof in a position to be manually engaged. The handle is constructed and arranged with respect to the cam slot to be guided axially by the cam slot when manually moved through a peripheral extent thereof so that the axial position of the handle within the cam slot determines the axial position of the movable cylindrical wall in telescoping relation with the input and output cylindrical walls. The movable cylindrical wall and one of the input and output cylindrical walls have cooperating flow control surfaces movable relatively axially toward and away from one another as the movable cylindrical wall is moved axially with the handle in response to a manual peripheral movement thereof. The cooperating flow control surfaces are constructed and arranged to vary the flow from the inlet through the cylindrical walls to the outlet in accordance with the position of the handle within the cam slot.

Another object of the present invention is the provision of a sprinkler assembly of the type described having an improved manually adjustable flow timing mechanism. In accordance with the principles of the present invention, this objective is obtained by providing a sprinkler assembly comprising a housing assembly having an inlet end constructed and arranged to be connected to a source of water under pressure and a spaced outlet end. A sprinkler head assembly is mounted on the housing assembly in communicating relation with the outlet end of the housing assembly constructed and arranged to discharge water under pressure in a predetermined stream configuration. A structural connection is provided between the outlet end of the housing assembly and the sprinkler head assembly constructed and arranged to enable the sprinkler head assembly to be oscillated about an oscillatory axis with respect to the housing assembly. An oscillating mechanism is carried by the housing assembly adjacent the outlet end thereof and includes an oscillating output member connected with the sprinkler head assembly constructed and arranged to move the sprinkler head assembly through repeated oscillating head cycles during which water under pressure issued from the sprinkler head assembly is distributed in a predetermined pattern on a ground area to be sprinkled. Each of the oscillating head cycles includes a head stroke in one direction and a return head stroke in the opposite direction so that a corresponding dimension of the water pattern corresponds with the distance of the head stroke of each head cycle. An adjusting mechanism is provided which is constructed and arranged to enable the distance of the head stroke of each head cycle to be adjusted within a range between a minimum head stroke distance and a maximum head stroke distance so as to vary the corresponding dimension of the water pattern within a range between a minimum dimension and a maximum dimension. A water flow valve is carried by the housing assembly adjacent the inlet end thereof which is constructed and arranged to be moved between (1) a closed position preventing the flow of water under pressure from the inlet end to the outlet end of the housing assembly and (2) an open position permitting the flow of water under pressure from the inlet end to the outlet end of the housing assembly. A valve-moving mechanism is carried by the housing assembly which is constructed and arranged to be manually moved away from a valve-closing position into a selected watering position within a range of watering positions between a minimum watering position and a maximum watering position, the valve-moving mechanism being constructed and arranged with respect to the flow control valve to enable the flow control valve to be (1) in the closed position thereof when the valve-moving mechanism is in the valve-closing position thereof and (2) in the open position thereof when the valve-moving mechanism is within the range of watering positions thereof. A constant stroke producing mechanism is carried by the housing assembly and includes (1) an oscillating input member connected with the oscillating output member to be moved thereby through repeated oscillating input cycles corresponding to the repeated oscillating head cycles the sprinkler head assembly is moved by the oscillating output member and (2) a constant stroke output member constructed and arranged to produce a movement stroke of a constant distance for each head cycle irrespective of the stroke distance within the range of stroke distances of each head cycle. A motion-transmitting assembly is carried by the housing assembly which is constructed and arranged to transmit the movement strokes of the constant stroke output member to the valve-moving mechanism to move the valve-moving mechanism from a selected watering position within the range of watering positions into said valve-closing position so that the amount of water delivered to the water pattern per unit area is determined by the selected watering position irrespective of the corresponding dimension of the pattern within the range of dimensions.

Another object of the present invention is the provision of a sprinkler assembly of the type described having an improved oscillating mechanism. In accordance with the principles of the present invention, this objective is accomplished by providing a sprinkler assembly comprising a housing assembly having a water inlet end constructed and arranged to be communicated with a supply of water under pressure and a spaced outlet end. A water jet and impeller reversing assembly is disposed within the housing assembly and includes a movable member constructed and arranged to be moved between first and second positions, a rotatable impeller, structural surfaces for directing a continuous supply of water under pressure from the housing assembly inlet end in jet formation onto the impeller to rotate the same, and a rotatable output member, the arrangement being such that when the movable member is in the first position the output member is connected to be rotated by the rotation of the impeller in one direction and when the movable member is in the second position the output member is connected to be rotated by the rotation of the impeller in an opposite direction. A planetary gear assembly is mounted within the housing assembly and comprises a multiplicity of gears including coaxial sun and ring gears and carrier mounted planetary gears in meshing relation between coaxial sun and ring gears. One of the ring gears is a movable ring gear mounted within the housing assembly for arcuate movement about an axis thereof between first and second positions, the movable ring gear is connected with the movable member to move the movable member (1) from the first position thereof into the second position thereof when the movable ring gear is moved from the first position thereof to the second position thereof and (2) from the second position of the movable member into the first position thereof when the movable ring gear is moved from the second position thereof into the first position thereof. A sprinkler head assembly is connected in water pressure communicating relation with the outlet end of the housing assembly which is constructed and arranged to discharge water under pressure in a predetermined configuration therefrom. A structural connection is provided between the outlet end of the housing assembly and the sprinkler head assembly which is constructed and arranged to enable the sprinkler head assembly to be moved about an axis. The multiplicity of gears includes an input gear connected to be moved about the axis of the movable ring gear by the rotatable output member and an output gear movable about the axis of the ring gear and connected to move the sprinkler head about its axis in a direction corresponding to the direction of movement of the output gear. A stop system is provided which acts between the sprinkler head assembly and the housing assembly and is constructed and arranged to determine first and second stopping positions for the sprinkler head assembly. The arrangement is such that the sprinkler head assembly is moved about its axis (1) in a direction toward the first stopping position when the movable ring gear is retained in the first position thereof with the rotatable output member rotating in one direction and the input and output gears moving in directions corresponding thereto so that when the sprinkler head assembly reaches the first stopping position the movement of the sprinkler head assembly is stopped while the continued rotation of the rotatable output member in one direction and the corresponding movement of the input gear cause the movable ring gear to be moved about its axis from the first position thereof to the second position thereof and (2) in an opposite direction toward the second stopping position when the movable ring gear is retained in the second position thereof with the rotatable output member rotating in the opposite direction and the input and output gears moving in directions corresponding thereto so that when the sprinkler head assembly reaches the second stopping position the movement of the sprinkler head assembly and output gear is stopped while the continued rotation of the rotatable output member in the opposite direction and the corresponding movement of the input gear cause the movable ring gear to be moved about its axis from the second position thereof to the first position thereof.

Another object of the present invention is the provision of a sprinkler assembly of the type described having an improved oscillating head stroke adjusting mechanism. In accordance with the principles of the present invention, this objective is accomplished by providing a sprinkler assembly comprising a housing assembly having an inlet end constructed and arranged to be connected with a source of water under pressure and a spaced outlet end. A sprinkler head assembly is mounted on the housing assembly in communication with the housing assembly output end which is constructed and arranged to discharge water under pressure therefrom in a predetermined stream configuration. A structural connection is provided between the sprinkler head assembly and the housing assembly which is constructed and arranged to enable the sprinkler head assembly to be moved about an oscillatory axis with respect to the housing assembly. An oscillating mechanism is carried by the housing assembly which is constructed and arranged to be operable by the flow of water under pressure between the inlet end and outlet end of the housing assembly to move the sprinkler head assembly about the oscillation axis thereof through repeated oscillating head cycles during which water under pressure discharged from the sprinkler head assembly is distributed in a predetermined pattern on the ground. Each of the oscillating head cycles includes a head stroke in one direction and a return head stroke in the opposite direction so that a corresponding dimension of the water pattern corresponds with the distance of the head stroke of each head cycle. An adjusting mechanism is provided which is constructed and arranged to enable the distance of the head stroke of each head cycle to be adjusted within a range between a minimum head stroke distance and a maximum head stroke distance so as to vary the corresponding dimension of the water pattern within a range between a minimum dimension and a maximum dimension. The adjusting mechanism includes first and second side-by-side adjusting rings mounted on an annular housing section of the housing assembly which is constructed and arranged to be moved into first and second selected adjustment positions within first and second ranges of adjustment positions. The first and second rings have first and second fixed stop surfaces thereon disposed in arcuately spaced relation to one another when the rings are in selected first and second adjustment positions. The sprinkler head assembly has cooperating first and second stop surfaces thereon disposed in a position to engage the fixed first and second stop surfaces at the end of each head stroke and return stroke of the sprinkler head assembly respectively. Each of the first and second rings is split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof. The annular housing section has a series of outwardly facing serrations on the exterior surface thereof of a size and shape to mesh with the plurality of serrations of the arcuate sections. Each of the first and second rings is constructed and arranged to be moved from any selected first or second adjustment position respectively to any other selected first or second adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of the annular housing section.

These and other objects of the present invention will become more apparent during the course of the following detailed description and appended claims.

The invention may best be understood with reference to the accompanying drawings wherein an illustrative embodiment is shown.

DETAILED DESCRIPTION OF THE DRAWINGS

DETAILED DESCRIPTION OF THE PREFERRED WAVE TYPE UNITIZED SPRINKLER ASSEMBLY

Figure 1:
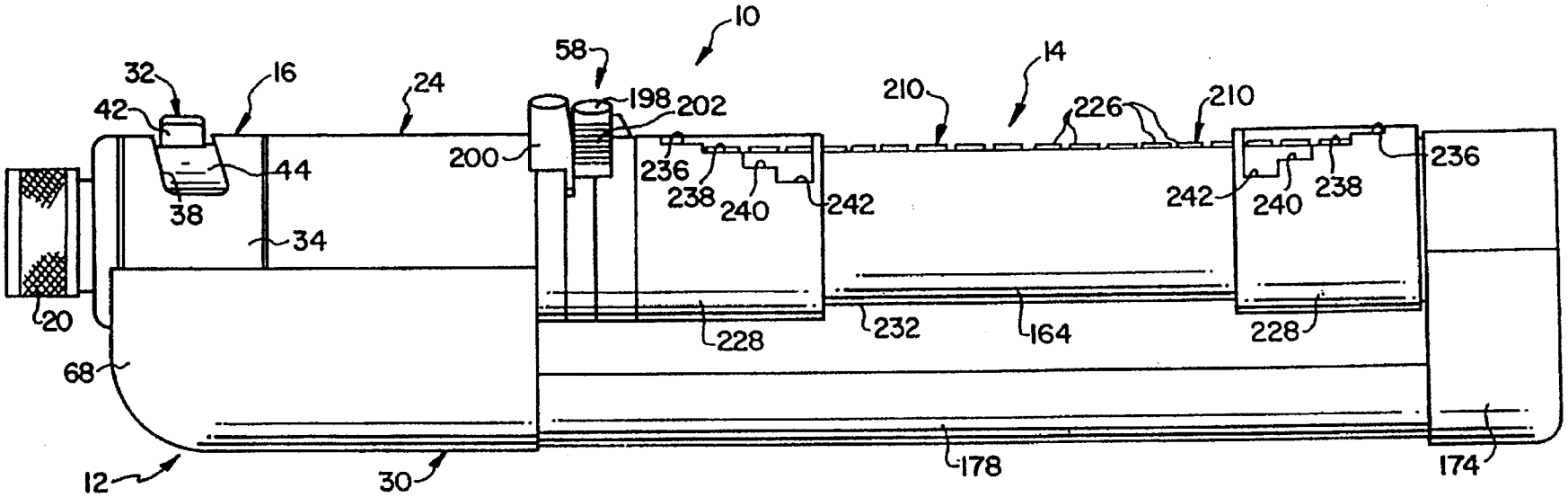
FIG. 1 is a side elevational view of one embodiment of a unitized sprinkler assembly embodying the principles of the present invention.
Figure 2:
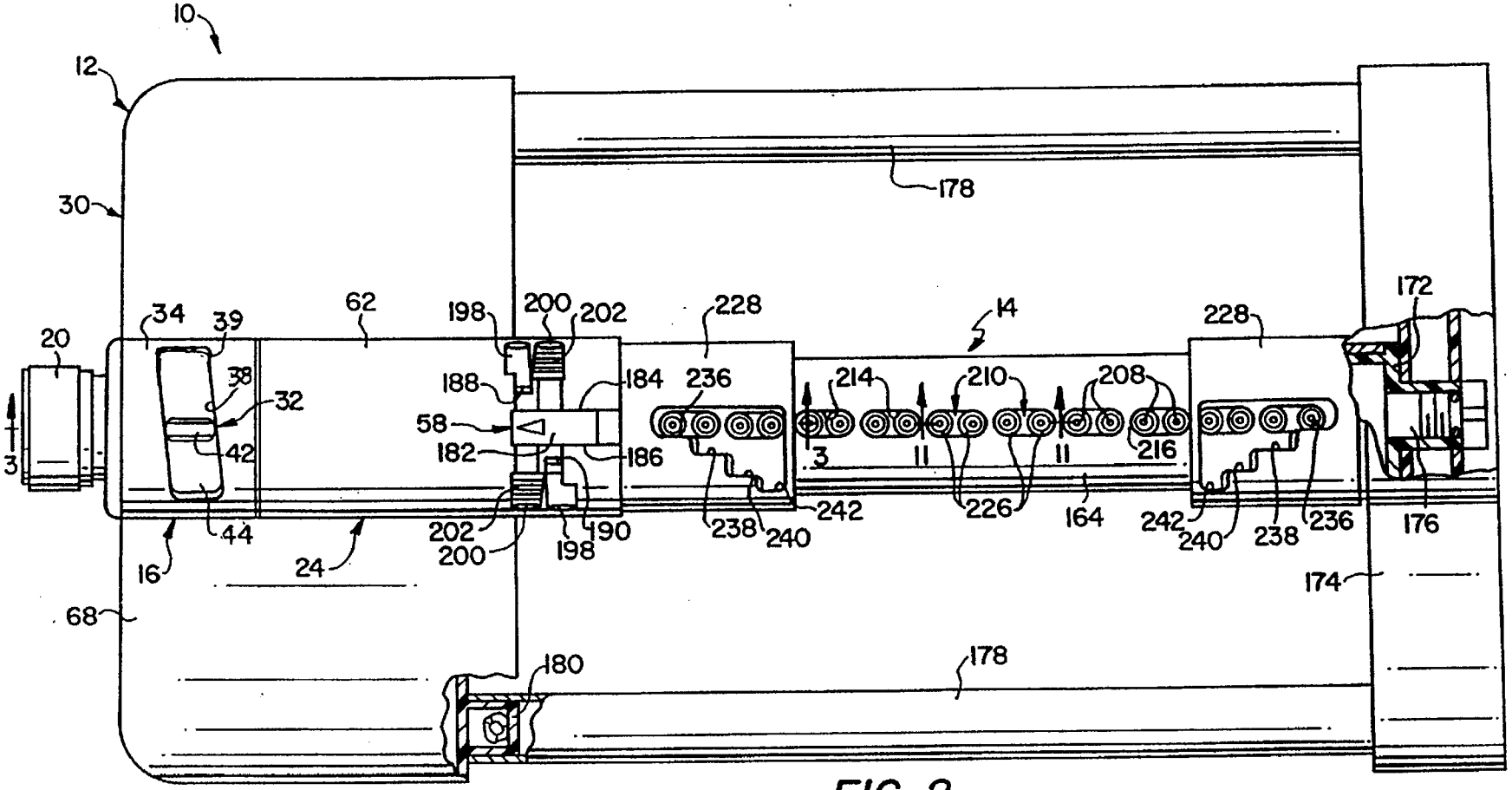
FIG. 2 is a top plan view of the sprinkler assembly shown in FIG. 7 with parts broken away for purposes of clear illustration.
Figure 3:
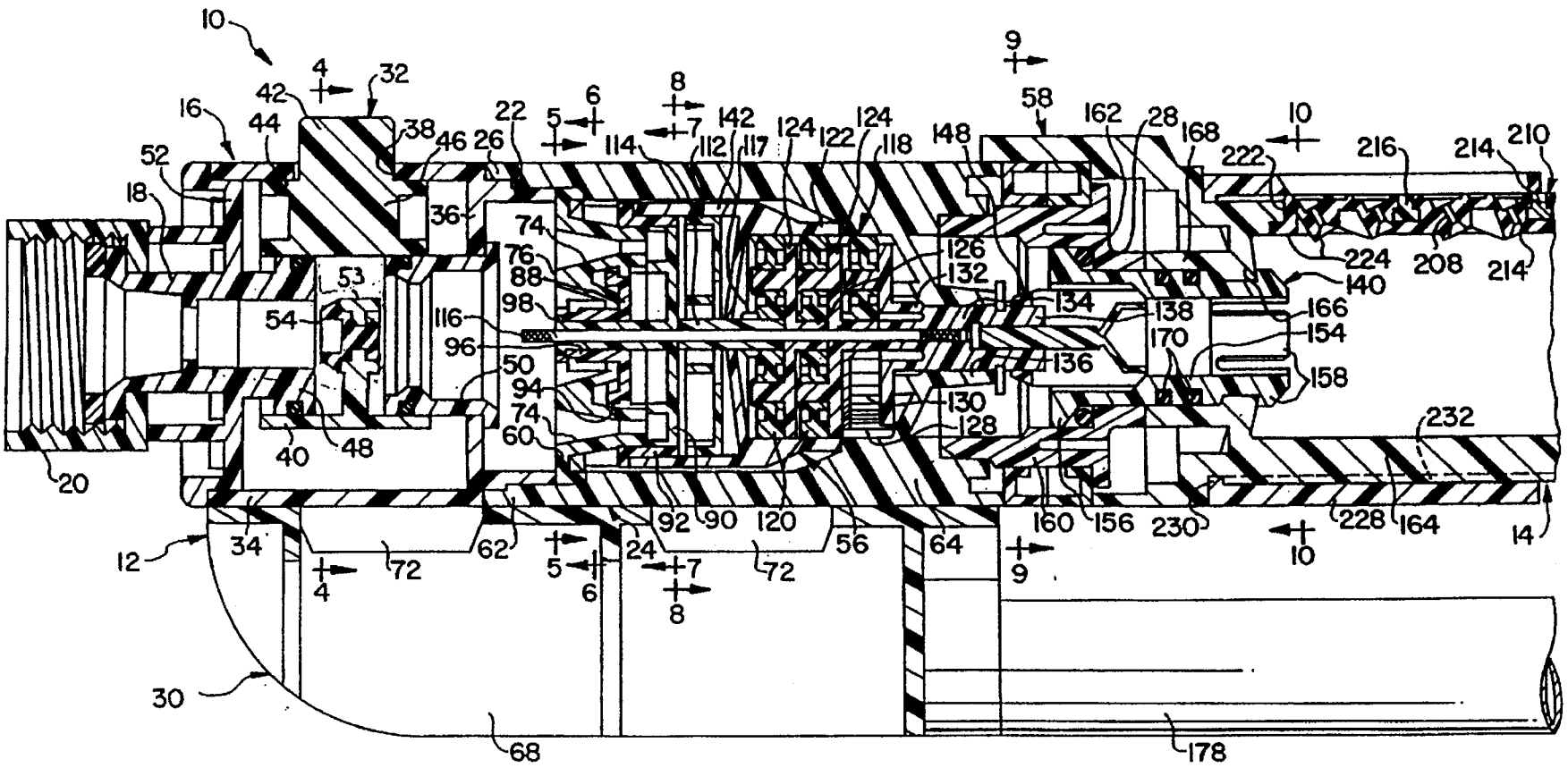
FIG. 3 is an enlarged fragmentary sectional view taken along the line 3—3 of FIG. 2.

Referring now more particularly to FIGS. 1–3 of the drawings, there is shown therein one embodiment of a unitized sprinkler assembly, generally indicated at 10, which embodies the principles of the present invention.

The sprinkler assembly 10 includes in general a housing and base assembly, generally indicated at 12, and a sprinkler head assembly, generally indicated at 14, mounted on the base and housing assembly 12 for movement about an oscillatory axis through repeated oscillating cycles, each of which includes a forward stroke in one direction and a return stroke in the opposite direction.

In the embodiment shown in FIGS. 1–3, the housing and base assembly 12 includes three subassemblies. First, a first housing assembly, generally indicated at 16, which includes an inlet end 18 defined by a conventional female hose coupling element 20 and a spaced outlet end 22. Second, a second housing assembly, generally indicated at 24, which includes an inlet end 26 disposed in water communicating relation with respect to the outlet end 22 of the first housing assembly 16 and an outlet end 28 which communicates with an inlet end of the tubular sprinkler head assembly 14. The third subassembly component is a base assembly, generally indicated at 30. The base assembly 30 has a fixed snap action connection with the first and second housing assemblies 16 and 24, respectively.

DETAILED DESCRIPTION OF THE PREFERRED MANUALLY ADJUSTABLE FLOW CONTROL MECHANISM UNIT

Mounted within the first housing assembly 16 is a manually adjustable control mechanism, generally indicated at 32. The control mechanism 32 and the first housing assembly 16 within which it is mounted constitutes a first unit of the unitized sprinkler assembly 10 of the present invention. The control mechanism 32, shown in FIGS. 1–3, is in the form of a flow control assembly embodying the principles of the present invention.

As best shown in FIGS. 1–4, the first housing assembly 16 includes a cylindrical peripheral housing wall 34 having an open inlet end and an annular wall 36 extending inwardly from an outlet end thereof. Formed in a central upper portion of the peripheral wall 34 is a cam slot 38. The cam slot 38 is configured to extend from one end thereof peripherally to an opposite end thereof and be displaced axially from the first end a distance substantially less than the peripheral distance between the ends thereof. As shown, the cam slot 38 at the first end thereof includes parallel flat portions 39. Thereafter, the configuration of the cam slots 38, as shown, is helical. The flow control mechanism 32 is in the form of unitary movable flow control structure which includes a central movable cylindrical wall 40 and a digitally engageable handle 42. The handle 42 is oriented axially and is disposed in radially outwardly extending relation from the axis of the movable central cylindrical wall 34. Extending outwardly from the end of the handle 42 opposite from its free end is a cylindrical wall section 44 which has a shape sufficient to slidably engage the interior surface of the peripheral wall 34 and cover cam slot 38. Appropriate reinforcing ribs 46 extend between the cylindrical wall section 44 and the adjacent exterior of the movable cylindrical wall 40.

The flow control mechanism 32 is assembled in movable operative relation within the first housing assembly 16 by moving the same axially through the open inlet end of the peripheral wall 34 and then moving the same transversely in the direction of the handle 42 to move the handle 42 through the cam slot 38 and interengage the exterior surface of the cylindrical wall section 44 with the interior surface of the peripheral housing wall 34. It will be understood that the dimension from the free end of the handle 42 to the opposite end of the movable cylindrical wall 40 is less than the interior dimension of the peripheral wall 34. The size of the handle 42 is such that its axial dimension just fits within the cam slot 38 so that as the handle 42 is moved peripherally it is guided for axial movement. The size of the cylindrical section 44 is such as to close the cam slot 38 interiorly in any position of movement of the handle.

The flow control mechanism 32 is supported for oscillatory movement about the axis of the cylindrical peripheral wall 34 by inlet and outlet cylindrical walls 48 and 50 forming a part of the first housing assembly 16 and disposed in sealed telescoping relation with respect to inlet and outlet portions of the movable cylindrical wall 40 respectively. The inlet cylindrical wall 48 forms a part of an inlet housing member providing the inlet 18 and includes an annular wall 52 which extends outwardly from the inlet cylindrical wall 48 and is fixed, as by plastic welding or the like, in closing relation to the open inlet end of the peripheral wall 34.

The outlet cylindrical wall 50 extends through the outlet annular wall 36 at the outlet end of the peripheral wall 34 and has an outwardly extending flange on the upstream end thereof which is fixed, as by welding or gluing to the annular wall 36. As shown, the inlet and outlet cylindrical walls 48 and 50 extend telescopically within the movable central wall 40, although the reverse arrangement could be provided. As shown, each of the inlet and outlet cylindrical walls 48 and 50 are formed with exterior annular grooves for receiving an O-ring seal which ensures a liquid tight telescopic relationship between the three cylindrical walls 48, 40 and 50.

Figure 4:
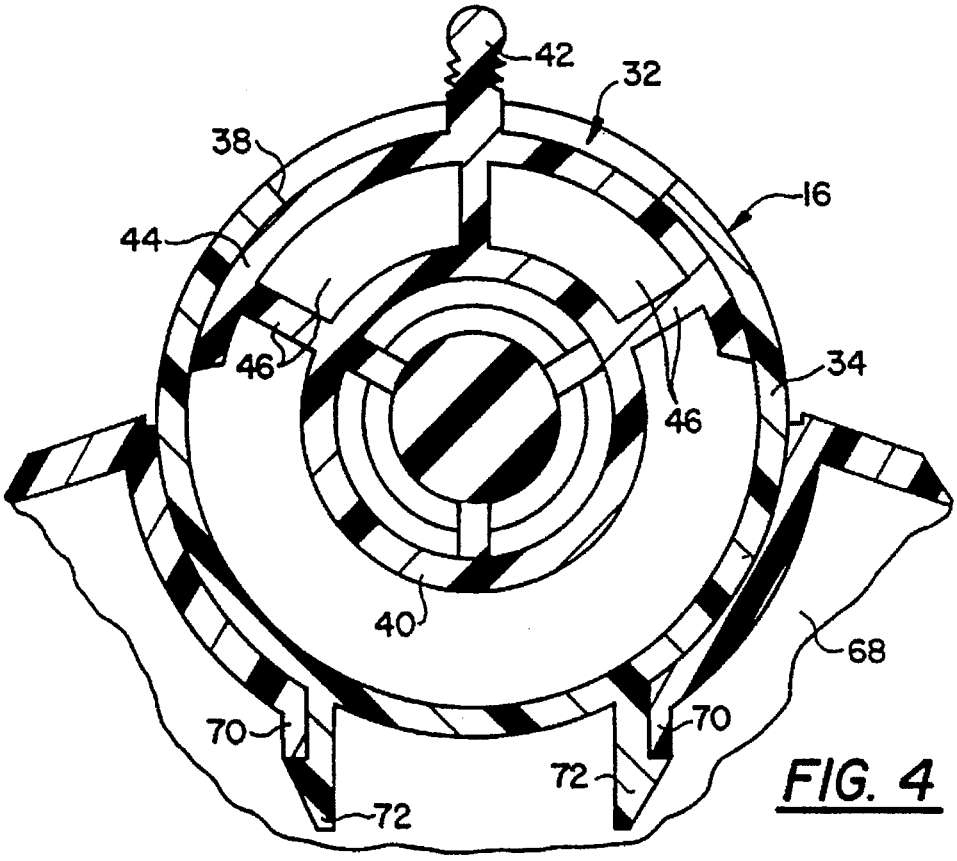
FIG. 4 is an enlarged fragmentary sectional view taken along the line 4—4 of FIG. 3.

Formed integrally as part of the flow control mechanism 32 within the central portion of the movable cylindrical wall 40 is an annular support structure 53 which serves to fixedly support therein a resilient flow control element 54. As best shown in FIG. 4, the annular support structure 53 and the flow control element 54 supported therein are retained in fixed relationship to movable cylindrical wall 40 by three integral ribs annularly spaced therearound. In the embodiment shown, the inner end of the inlet cylindrical wall 48 constitutes a second flow control element, although the outlet cylindrical wall could be utilized instead.

It will be understood that, when the handle 42 is at the first end of the cam slot 38 between the flat portions 39, the resilient flow control element 54 is disposed in engagement with the inner end of the inlet cylindrical wall 48. In this position, the flow rate is minimized essentially to zero. The ability of the flow control mechanism 32 to effectively shut off the flow is desirable in that it provides the user with the capability of shutting off the flow at the sprinkler when the position of operation is changed.

It will also be noted that, as the handle 42 is moved peripherally within the cam slot 38, the cam slot serves to guide the flow control mechanism 32 axially. The configuration of the cam slot 38 and the engagement of the handle 42 therein are such as to resist movement of the flow control mechanism 32 axially by virtue of water pressure acting on the flow control element 54 tending to move the same toward the outlet. It will be understood that the arrangement is such that the flow control mechanism 32 will be retained in any position into which it is moved by manual digital manipulation of the handle 42. As previously indicated, when the handle 42 is in a position against the first end of the cam slot 38 closest to the inlet 18, the cooperation flow controller faces on the flow control element 54 and inner end of inlet cylindrical wall 48 are together and a minimum no flow is permitted. When the handle 42 is moved to the opposite end of the cam slot 38 the flow will be the greatest. The arrangement permits any selected flow rate between the minimum and maximum by simply moving the handle in a peripheral direction into the selected position where it will stay.

DETAILED DESCRIPTION OF PREFERRED OSCILLATING MECHANISM UNIT

Mounted within the second housing assembly 24 is an oscillating mechanism in the form of a water jet and impeller reversing assembly, generally indicated at 56. The oscillating mechanism 56 and the second housing assembly 24 within which it is mounted constitutes a second unit of the unitized sprinkler assembly 10 of the present invention.

In accordance with the principles of the present invention, the oscillating mechanism 56 is constructed and arranged to be operable by the flow of water under pressure between the inlet 26 and outlet 28 of the second housing assembly 24 to move the sprinkler spray head assembly 14 through the repeated oscillating head cycles thereof during which water under pressure discharged from the sprinkler head assembly 14 is distributed in a predetermined pattern on the ground. Each of the oscillating head cycles includes a head stroke in one direction and a return head stroke in the opposite direction so that a corresponding dimension of the water pattern corresponds with the distance of the forward or reverse stroke of each head cycle. A stop system in the form of an adjusting mechanism, generally indicated at 58, is provided for adjusting the distance of the head stroke of each head cycle within a range between a minimum head stroke distance and a maximum head stroke distance so as to vary the corresponding dimension of the water pattern within a range between a minimum dimension and a maximum dimension. The adjustment also determines the position of the pattern with respect to the sprinkler itself.

Figure 5:
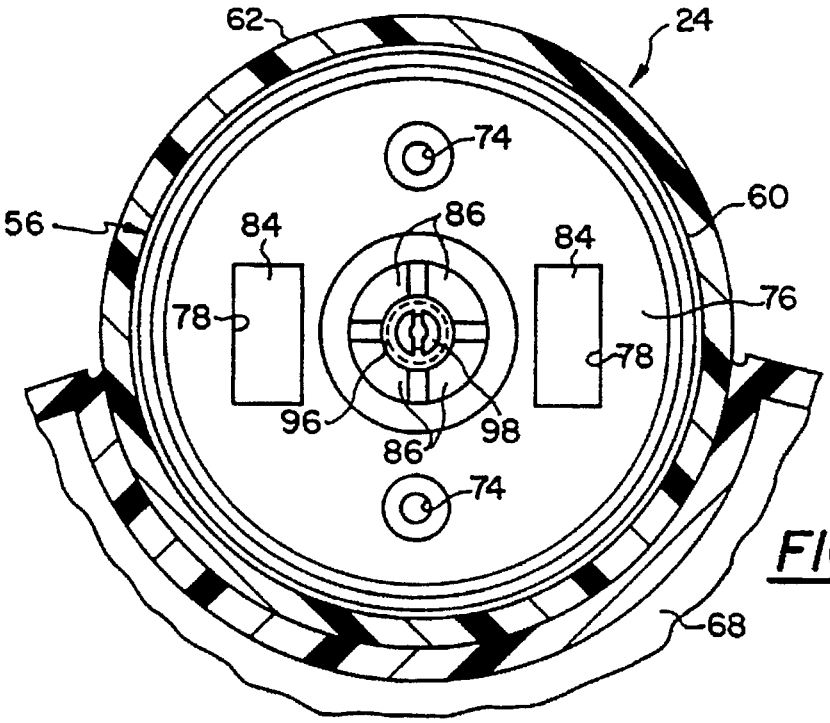
FIG. 5 is an enlarged fragmentary sectional view taken along the line 5—5 of FIG. 3.
Figure 6:
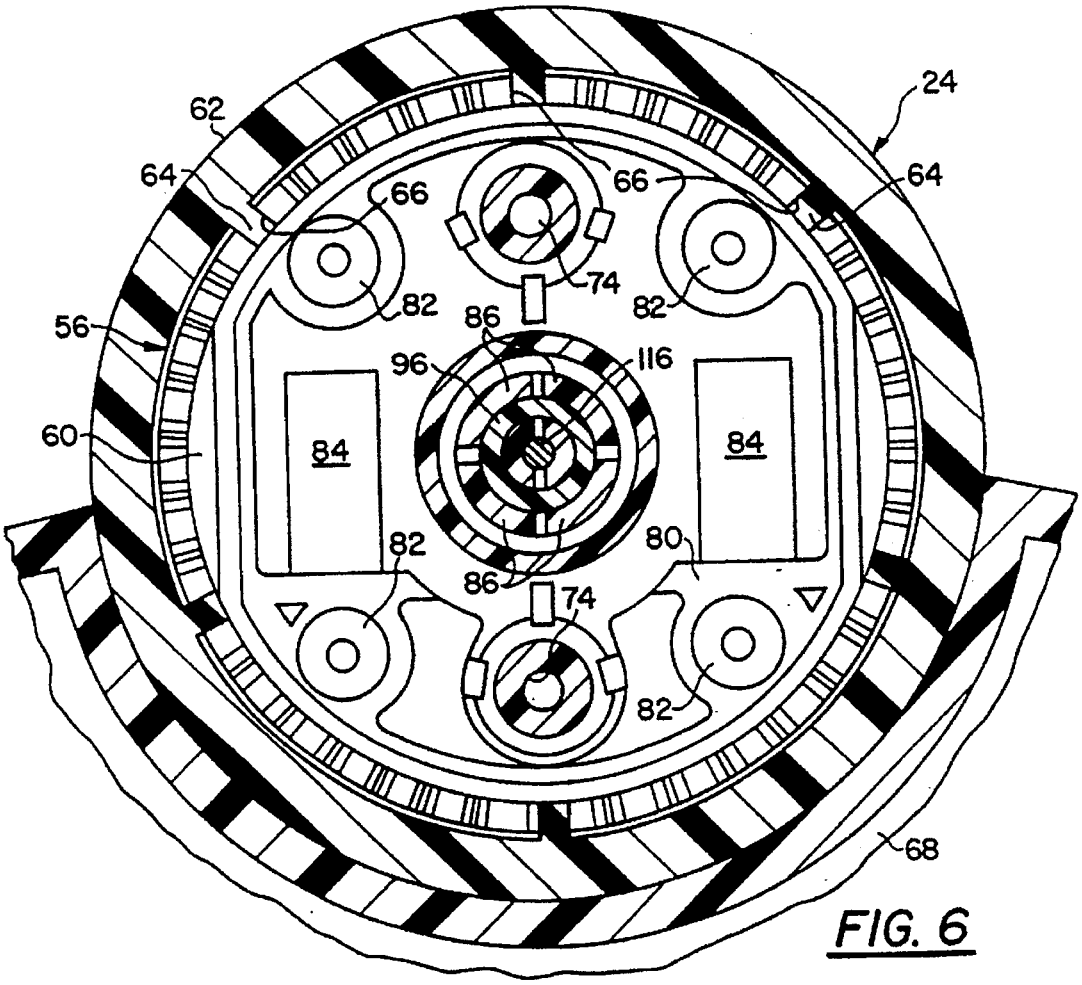
FIG. 6 is a greatly enlarged fragmentary sectional view taken along the line 6—6 of FIG. 3.

As best shown in FIGS. 3, 5 and 6, the oscillating mechanism 56 includes an inlet end member 60 which is sized to be mounted within the open inlet end 26 of a peripheral housing wall 62 forming a part of the second housing assembly 24. Formed on the interior periphery of the housing wall 62 is a series of annularly spaced ribs 64 which end spaced from the inlet end 26 of the housing wall 62. The end member 60 includes an axially extending flange formed with a series of teeth which define troughs 66 therebetween. The end member 60 is fed into the open inlet end 26 of the housing wall 62 until the ends of the ribs 64 engage within registering troughs 66 between the teeth thus ensuring that the end member 60 is properly positioned and will not move in a rotational sense with respect to the housing wall 62. Preferably, the outlet 22 of the first housing assembly 14 is a generally short cylindrical wall that extends within the interior periphery of the inlet end 26 of the housing wall 62 into engagement with the end member 60 to retain the same in fixed relation axially within the housing wall 62. If desired, the outlet 22 of the first housing assembly 16 can be welded or otherwise secured to the inlet 26 housing wall 62 although this is not necessary since both peripheral walls are affixed to a common base member 68.

As best shown in FIGS. 3, 4, 7 and 8, base member 68 is of generally rectangular configuration in plan with a central axially extending depression of inverted arcuate configuration shaped to engage the lower portion of the two cylindrical housing walls 34 and 62. The arcuate depression of the base member 68 is formed with openings in the central portion thereof and the opposite sides of the openings are defined by downwardly extending flanges 70. Each of the housing walls 34 and 62 include barb-like extensions 72 formed integrally on the exterior periphery thereof which are adapted to move through an associated opening and snap under lower ends of the associated flanges 70. In this way the first and second housing assemblies 16 and 24 are retained in operative relation with one another and on the base member 68. It will be understood that housing wall 34 need not include extensions 72 in view of the fixed connection of the housing outlet wall 22 with the inlet 26 of the housing wall 62.

The end member 60 includes a pair of hollow frustoconical portions defining a pair of nozzles 74 which extend inwardly from a water-restricting surface 76 thereof facing the outlet 22 of the cylindrical wall 34. The interior surfaces of the nozzles 74 confine the flow of water under pressure into jet formations which issue from the nozzles 74 in an axial direction.

The end member 60 also includes a pair of rectangularly-shaped bypass openings 78 extending therethrough, best shown in FIG. 5. Fixed to the surface of the end member opposite from the surface 76 is a thin plastic structure 80 which is fixed thereto as by integral columns 82 on the member 60 extending through openings in the thin plastic element and fused thereover to effect a fixed securement. The thin plastic structure 80 includes two cantilevered flap valve elements 84 which cover the bypass openings 78 and normally prevent flow of water through the bypass openings 78. The flap valve elements 84 are capable of yielding to allow a bypass flow in instances where the pressure of the water confined by surface 76 reaches a predetermined above normal level. The end member 60 also includes a central hub structure which includes an outer frusto-conical wall extending from the surface 76 inwardly and a cylindrical wall extending outwardly from the inner end of the frusto-conical wall split to define arcuate sectors 86 terminating in an inwardly turned flange.

Mounted inwardly of the end member 60 are cooperating first and second movable members 88 and 90 which serve to initiate and accomplish the reversing function. The first movable member 88 is an annular member having a peripheral wall 92 extending axially inwardly from the periphery thereof with a flange extending outwardly from one end thereof. Formed in diametrically opposed relation within the first movable member 88 is a pair of vector shaped openings 94 which receive the inner ends of the nozzles 74. A sleeve or hub extends axially outwardly from the center of the first movable member 88, the sleeve 96 being formed with a peripheral groove. The sleeve 96 is capable of being moved into the arcuate sectors 86 with a snap action with the inner flanges of the arcuate sectors 86 being engaged within the exterior groove of the sleeve 96. In this way, the first movable member 88 is mounted for rotational movement about the axis of the housing wall 62 for movement between first and second limiting positions. The radial edges defining the vector shaped openings 94 limit the movement of the movable member 88 by engagement with the nozzles 74 at each end of the vector shaped opening.

Figure 7:
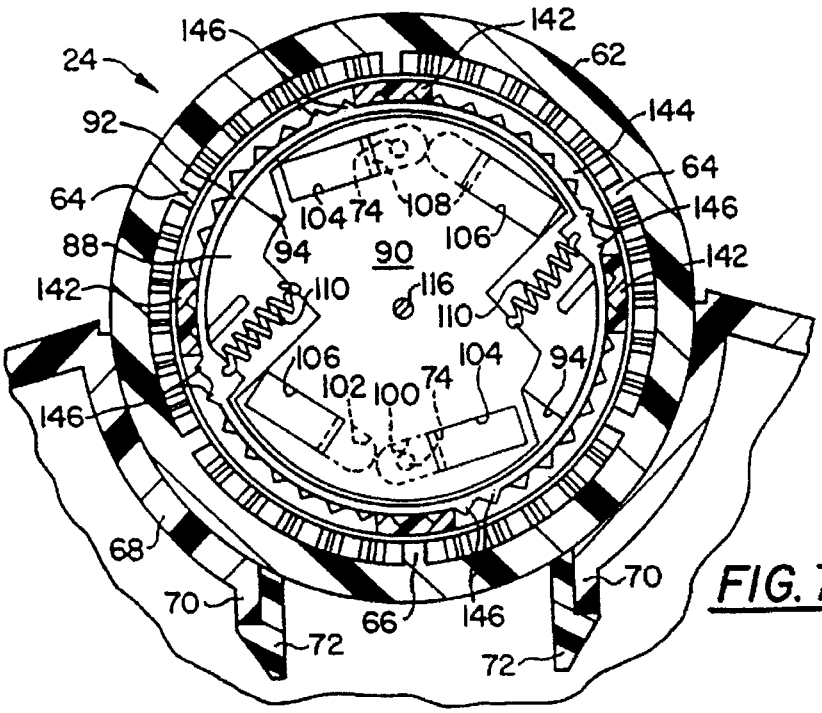
FIG. 7 is an enlarged fragmentary sectional view taken along the line 7—7 of FIG. 3.

As best shown in FIGS. 3 and 7, the cooperating second movable member 90 is mounted within the peripheral wall 92 of the first movable member 88. The second movable member 90 includes a split hub 98 which is adapted to extend through the sleeve 96 of the first movable member 88 and to snap therein. The split hub 98 serves to mount the second movable member 90 for movement about the axis of the housing wall 62 between first and second limiting positions. Formed in the second movable member 90 in positions to receive the axially extending jet formation of water issuing from the nozzles 74 are pairs of generally right angle arcuate surfaces 100 and 102, respectively. Each pair of arcuate surfaces 100 and 102 are oppositely directed and extend from one position tangentially in opposite directions. Each pair of arcuate surfaces 100 and 102 extends to a pair of openings 104 and 106 extending tangentially therefrom which are formed in the second movable member 90. Extending from the walls defining the adjacent ends of each pair of openings are stop walls 108 which engage the associated nozzle 74 and determine the first and second positions of the second movable member 90.

Connected between the first movable member 88 and the cooperating second movable member 90 is a pair of compression coil springs 110 having radially extending ends which are engaged in grooves respectively in the first and second movable members 88 and 90. The springs 110 serve to both hold the movable members into their limiting positions thereof and have an over center biasing action with respect to the second movable member 90 while the first movable member is moved. Thus, the springs 110 bias the second movable member 90 to remain in the first position thereof when the first movable member 88 is biased thereby in the first position thereof. The springs 110 bias the second movable member 90 to move from the first position thereof into the second position thereof when the first movable member 88 is moved from the first position thereof into the second position thereof. Thereafter, the springs 110 bias the second movable member 90 to remain in the second position thereof when the first movable member 88 is biased thereby in the second position thereof. Finally, the springs 110 bias the second movable member 90 to move from the second position thereof into the first position thereof when the first movable member 88 is moved from the second position thereof into the first position thereof.

It will also be noted that in the first position of the second movable member 90 the jet streams issuing from the nozzles 74 are directed tangentially by arcuate surfaces 100 through openings 104 in a first direction onto an impeller 112 to rotate the impeller 112 in one direction about the rotational axis thereof. When the second movable member 90 is moved into the second position thereof, the jet streams issuing from the nozzles 74 are directed tangentially by arcuate surfaces 102 through openings 106 in a second direction onto the impeller 112 to rotate the impeller 112 in a second and opposite direction about the rotation axis thereof.

Figure 8:
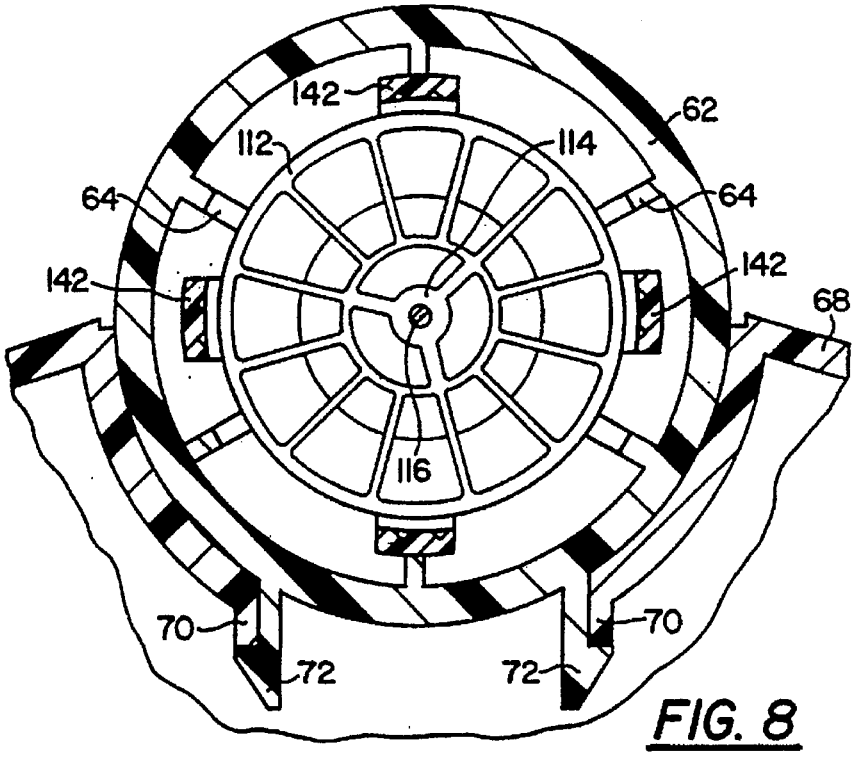
FIG. 8 is an enlarged fragmentary sectional view taken along the line 8—8 of FIG. 3.

As best shown in FIGS. 3 and 8, the impeller 112 includes a hub 114 which is journalled on a shaft 116 extending through the split hub 96 of the second movable member. The impeller 112 may be of any suitable construction and as shown is a unitary plastic molding including an inner annular wall which is connected to the hub 114 by ribs and a series of radially extending impeller blades which are integral with a peripheral wall. Extending inwardly from the peripheral wall is an annular wall which also connects the blades but allows for passage of water axially through the impeller 112 after having impinged on the blades thereof.

The hub 114 of the impeller 112 extends downstream and has teeth formed on the end portion thereof defining a sun gear 117 forming a part of a planetary gear assembly, generally indicated at 118. The sun gear 117 forms a part of a first stage of the planetary gear assembly 118 which also includes a pair of planetary gears 120 meshing with the sun gear 117 and a ring gear 122 meshing with the planetary gears 120. The planetary gears 120 are journalled on shafts of a carrier 124 journalled on shaft 116 which includes an integral second stage sun gear 117. The ring gear 122 is extended axially to form a part of the second stage and a pair of second stage planetary gears 120 complete the second stage. As before, the planetary gears 120 are journalled on shafts of a carrier 124 which also includes an integral third stage sun gear 126 journalled on the shaft 116.

The third stage includes a ring gear 128 which is formed integrally as a part of the peripheral wall 62, being integrally interconnected with the radially inward ends of the ribs 64 near the outlet end of the wall 62. The third stage also includes three planetary gears 130 which mesh with the sun gear 126 and ring gear 128. The planetary gears 130 are journalled on shafts of a carrier 132 which includes a forwardly extending output shaft 134. The output shaft 134 is journalled within a sleeve 136 which has a frusto-conical wall extending therefrom to the ring gear all of which forms an integral part of the housing wall 62. The output shaft 134 is held in place by a washer and the portion of the output shaft which extends therebeyond is formed into four separate annularly spaced projections 138, each of a square cross sectional configuration defining a square-shaped opening therewithin.

DETAILED DESCRIPTION OF THE PREFERRED WAVE TYPE SPRINKLER HEAD ASSEMBLY UNIT

It will be noted that the downstream end of the central shaft 116 terminates within the output carrier shaft 134 and is knurled to be fixed therein so as to move through repeated oscillating cycles therewith. In addition, the output shaft 138 is also connected with the sprinkler head assembly 14 which constitutes a third unit of the unitized sprinkler assembly 10 embodying the principles of the present invention. Preferably, the connection of the shaft 138 with the sprinkler head assembly 14 is made through a slip clutch connecting member, generally indicated at 140, so as to be moved through repeated oscillating cycles therewith. As previously indicated, the cycle stroke distance is determined by the setting of the stop system or adjusting mechanism 58.

While in its broadest aspects the present invention contemplates a conventional adjusting mechanism capable of creating a reversing movement at the end of each stroke which is transmitted to the first movable member 58 to reverse the drive direction; in the preferred embodiment shown, the adjusting mechanism 58 functions to simply stop the movement of the sprinkler spray head assembly 14 at the end of each stroke. Stopping the movement of the sprinkler head assembly 14 also stops the movement of the third stage of the planetary gear assembly 18, however, it does not stop the impeller 112 from moving since the water continues to flow. As the impeller 112 continues to move, the sun gear 116 will turn first stage planetary gears 120 causing the first stage carrier 124 to move, thus moving second stage sun gear 126. Rotation of the second stage sun gear 126 causes the second stage planetary gears 120 to rotate, but since third stage sun gear 126 is stopped the second stage carrier 124 integral therewith, likewise cannot move. Hence, the second stage planetary gears 120 will tend to be rotated about stationary shafts and this rotation is possible since the meshing ring gear 122 is not rigidly fixed. Instead, ring gear 122 is allowed to move and this movement is transmitted to the first movable member 88 to effect a reversal of the impeller 112 to begin the next stroke in the opposite direction. The motion of the ring gear 122 is transmitted to the first moving member 88 by a direct connection which, like the rib 64 in trough 66 mount of the end member 60, can accommodate any angular position of the end member 60.

As best shown in FIGS. 3, 7 and 8, four annularly spaced arms 142 are formed integrally on the ring gear 122 and extend axially therefrom in an upstream direction. An interiorly serrated ring 144 is integrally attached to the upstream ends of the arms 142. The ring 144 extends around the peripheral wall 92 of the first movable member 88. As best shown in FIG. 7, the peripheral wall has four pairs of teeth 146 spaced around the exterior thereof which enter between the interior serrations of the ring 144 to insure that movement of the ring gear 122 about the axis of shaft 116 will be transmitted to the first movable member 88.

Figure 9:
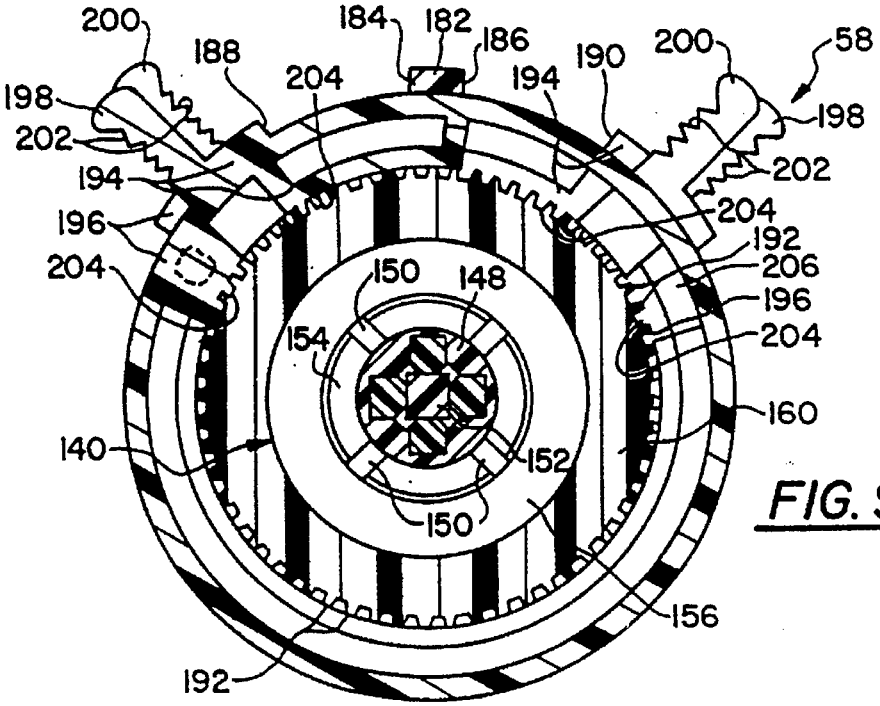
FIG. 9 is an enlarged sectional view taken along the line 9—9 of FIG. 3.
Figure 10:
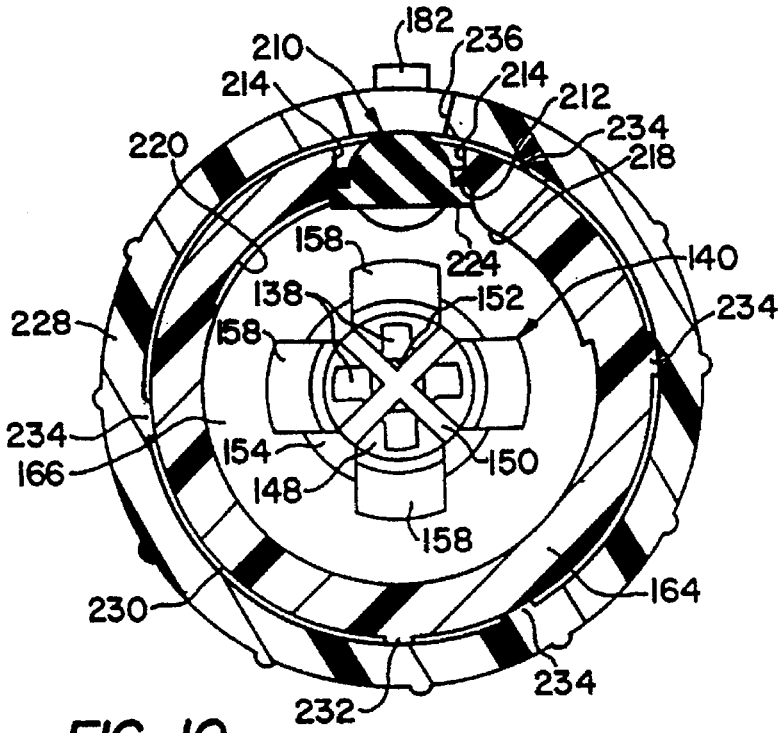
FIG. 10 is an enlarged sectional view taken along the line 10—10 of FIG. 3.
Figure 11:
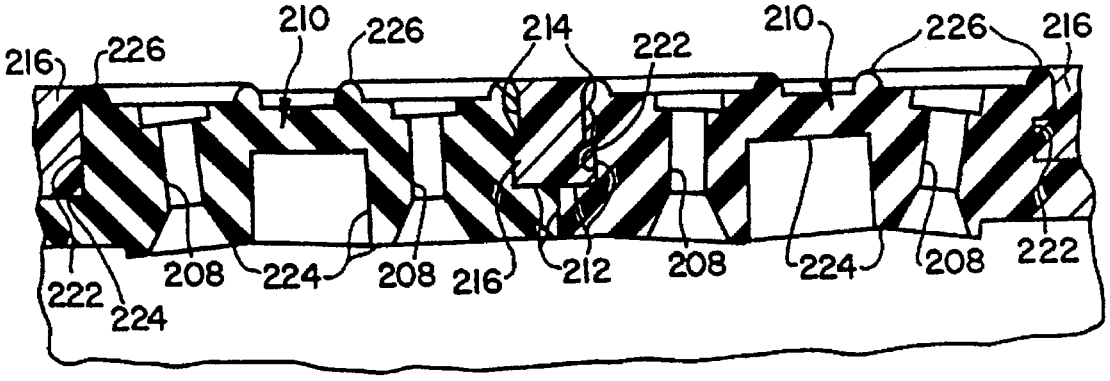
FIG. 11 is a greatly enlarged fragmentary sectional view taken along the line 11—11 of FIG. 2.

Referring now more particularly to FIGS. 3, 9 and 10, the upstream end of the connector member 140 includes a circular portion 148 which is shaped to receive the four projections 138. The circular portion 148 is integrally connected with four annularly spaced ribs 150 which carry a central projection 152 of square-shaped cross-sectional configuration adapted to interfit with the four projections 138. The ribs 150 are integral exteriorly with the main sleeve-like body 154 having an exterior flange 156 at an upstream end. The main body 154 of the connector member 140 is formed with a pair of annular grooves in its exterior periphery. In the downstream end portion thereof, which is of a lesser diameter, an exterior flange is formed on the exterior periphery thereof and the downstream end portion is slotted so as to provide four arcuate prong-like elements 158.

A tubular outlet housing closure member 160 of the second housing assembly 24 is mounted within the outlet end of the housing wall 62 in fixed relation, as by welding or the like, to define the outlet 28 of the second housing assembly 24. The closure member 160 includes an interior annular shoulder which faces upstream and an O-ring seal 162 is provided between this shoulder and the exterior upstream flange 156 on the connecting member 140 so as to ensure that all of the water under pressure flowing toward the outlet 28 of the second housing assembly 24 will flow through the connector member 140.

From the above, it can be seen that the connector member 140 is mounted for rotation with the output shaft 134 of the planetary gear assembly 56 through repeated oscillating cycles therewith. The downstream portion of the connector member 140 extending outwardly from the closure member 160 is adapted to mount the upstream end of the tubular sprinkler spray head assembly 14 for normal movement therewith. In this regard, it will be noted that the sprinkler spray head assembly 14 includes an elongated tubular head member 164 having an annular wall 166 extending radially inwardly from the upstream end thereof at a position spaced inwardly from the upstream extremity. Extending in an upstream direction from the annular wall 166 at a position outwardly from the interior inner periphery thereof is a cylindrical wall portion 168.

The tubular head member 164 is adapted to be connected to the connecting member 140 by simply moving the same axially over the prong-like elements 158 at the downstream end of the connecting member 140 until the inner periphery of the annular wall 166 engages behind the flanges of the elements 158 which flex to permit the achievement of the connection with a snap action. It will be noted that a pair of O-rings 170 are mounted within the annular grooves in the main body 154 of the connecting member 140 so as to engage the interior of the cylindrical wall portion 168. The friction of the O-rings 170 on the wall portion 168 and the gripping action of the prong-like elements 158 with the annular wall 166 normally maintain the tubular head member 164 in a fixed operative relation with respect to the connecting member 140 so that the tubular head member 164 will be oscillated as the connecting member 140 is oscillated. However, the connection will slip in the event that an undesired manual rotation is imparted to the tubular head member 164 which is incapable of being fed back through the planetary gear assembly 56.

As best shown in FIG. 2, the downstream end of the tubular head member 164 is open and is adapted to be closed by an annular closure member 172 which is rotatably supported on an upright base member 174 forming a part of the base assembly 30. The closure member 172, as shown in FIG. 2, has a removable plug 176 therein. The base member 174 is interconnected with the base member 68 by a pair of metal tubes 178. The ends of the tubes 178 are connected by staking them transversely into hollow wall sections 180 forming a part of the base members 68 and 174 extending into the open ends of the tubes. (See FIG. 2.)

The upstream end of the tubular head member 164 has an arm 182 formed on the exterior periphery thereof in radially outwardly extending relation. The arm 182 extends in an axial upstream direction beyond the upstream extremity of the tubular head member 164. The arm 182 provides first and second stop surfaces 184 and 186 which are adapted to engage first and second stop surfaces 188 and 190, respectively, provided by the adjusting mechanism 58.

DETAILED DESCRIPTION OF THE PREFERRED ADJUSTING MECHANISM

In the broadest aspects of the present invention, the adjusting mechanism 58 can assume any well-known configuration. However, in accordance with the principles of the present invention, a preferred embodiment is in the form of two stop or adjustment rings of substantially identical construction mounted in side-by-side mirror image relationship with respect to one another around an annular section of the housing closure member 160 which has a series of serrations 192 formed on the exterior periphery thereof.

As best shown in FIGS. 1, 2 and 9, each adjustment ring 58 is split so as to define a pair of side-by-side end portions 194 and 196 having a pair of pinching elements 198 and 200, respectively, fixed thereto and extending outwardly therefrom so as to present oppositely facing digital engaging surfaces 202.

As best shown in FIG. 9, the end portions 194 and 196 also provide a pair of short arcuate sections having serrations 204 on the interior thereof adapted to mesh with or interengage with the serrations 192 on the closure member 160. The end portions 194 and 196 are split in an axial direction so that the width of an outer end portion 194 is greater than the width of the inner end portion 196. The outer end portion 194 which has the larger width also extends arcuately to a greater extent than the inner end portion 196. The short inner end portion 196 has a stop element 206 extending axially therefrom. The remainder of each ring 58 which extends through approximately 330° of the ring has a generally U-shaped cross-sectional configuration in which the bight of the U is a radial wall, and the legs of the U are of unusual length. The shorter leg constitutes an interior axial wall and a larger peripheral wall. It will also be noted that first and second stop surfaces 188 and 190 are on end portions 194 and extend above the peripheral wall of the rings in a position to be engaged by the arm surfaces 184 and 186, respectively.

The construction of the first and second rings 58 is such that each can be moved from any selected first or second adjustment position respectively to any other selected first or second adjustment position respectively within first or second ranges of adjustment position respectively. The interengagement of the stop member elements 206 with the inner arcuate end of the associated end portion 194 is such that the lower limit of the range of the first and second adjustment positions is predetermined, as for example 30° apart. Movement of each ring 58 is accomplished by first digitally engaging the digital-engaging surfaces 202 of the associated pinching elements 198 and 200, then pinching the digital-engaging surfaces 202 toward one another which has the effect of enlarging the interior circumference of the associated ring 58 and displacing the associated inwardly facing serrations 204 with respect to the outwardly facing serrations 192 of the housing closure member 160. Thereafter, the associated ring 58 is moved from the selected adjustment position it is in arcuately in the appropriate direction into the other selected position while retaining the associated pinching elements 198 and 200 in pinched relation. Thereafter, they are released to enable the inherent resiliency of the ring 58 to engage the associated inwardly facing serrations 204 in meshing relation with the engaged outwardly facing serrations 192 of the housing closure member 160.

DETAILED DESCRIPTION OF THE PREFERRED WAVE TYPE SPRINKLER HEAD ASSEMBLY

Referring now more particularly to FIGS. 1–3, 10 and 11, the sprinkler spray head assembly 14 is provided with a series of openings 208 which allow the water under pressure which is received within the tubular head member 164 to discharge therefrom as a series of streams which fall onto the ground in a predetermined pattern as the sprinkler head assembly 14 moves through repeated oscillating cycles. As previously indicated, each cycle includes a stroke in one direction and a return stroke in the other direction and the distance of the stroke is determined by the setting of the adjustment rings 58. The openings 208 which define the streams issuing from the sprinkler head assembly 14 are constructed in accordance with the principles of the present invention. Specifically, the openings 208 are formed in a pair of elongated strips, generally indicated at 210, suitably molded of rubber-like material. In the embodiment shown, there are two strips 210 of identical configuration provided, although it will be understood that one or more than two such strips may also be utilized. The openings 208 in each strip 210 extend therethrough along an axis which is perpendicular at one end. The axis of each successive opening 208 is inclined slightly more in a direction toward the opposite end from the preceding one. When the two strips 210 are mounted in aligned mirror image relationship with respect to one another, the resultant streams are in a fan-shaped configuration which is desirable for a wave sprinkler. Stated differently, the water stream outlets in each strip are inclined progressively less in a direction from the end of the series so as to form the series of water streams into a fan-shaped spray.

The strips 210 are mounted in an elongated section of the tubular head member 164. As best shown in FIG. 10, the tubular head member 164 is molded of a plastic material to include strip-engaging surfaces 212 of generally wide inverted U-shaped configuration and opening-defining surfaces 214 of a stepped cross-sectional configuration so that each opening is formed with a flange at its lower portion. As best shown in FIG. 1, the openings defined by surfaces 214 are disposed in axial alignment and spaced slightly apart by short transversely extending portions 216 of the tubular head member 164. Preferably, the walls on opposite sides of the openings and portions 216 are formed with different thicknesses. Thus, as shown in FIG. 10, the wall has an added dimension thereto as indicated at 218, while on the opposite side, the wall has a recess therein, as indicated at 220. This configuration ensures that, as the molding takes place, the molten plastic material which enters the mold cavity will flow across the spaces in the mold which define the short portions 216 from the thick side 218 to the thin side 220. This construction ensures that the merger of the plastic material will occur at the thin side 220 rather than in the middle of the short portions 216 as would be the case if the two wall thicknesses were the same. If the plastic material is allowed to meet in the center of the short portions 216, short portions 216 would be of reduced strength and subject to possible fracture which is not the case with the present construction where the juncture would occur along the recessed wall thickness 220.

The axial dimension of each opening defined by surfaces 214 is of a size to receive two adjacent strip openings 208 extending through the strip 210. Each strip 210 includes exterior mounting surfaces 222 which engage the strip-engaging and opening-defining surfaces 212 and 214 of the tubular head member 164. Preferably, these mounting surfaces 222 are such as to extend or snap over the opening flanges defined by surfaces 214 when the strip 210 is extended into the end of the tubular head member 164 and moved radially outwardly through the openings defined by surfaces 214. Each strip 210 also includes interior pressure responsive surfaces 224 and integral exterior O-rings 226 which extend around each opening 208. It can be seen that, in operation, the pressure applied by the water under pressure within the tubular head member 164 acting on the pressure responsive surfaces 224 of each strip 210 serves to enhance the engagement of the mounting surfaces 222 thereof with the interior strip-engaging surfaces 212 of the tubular head member 164.

The O-rings 226 of each strip 210 are adapted to extend slightly beyond the peripheral surface of the tubular head member 164 and, in accordance with the principles of the present invention, there is provided a pair of tubular control members 228 movably mounted over opposite ends of the tubular head member 164 for movement into a plurality of adjustment positions enabling the operator to vary the width of the fan-shaped spray configuration which issues from the openings 208. The tubular control members 228 are of cylindrical construction and mounted in mirror image relation with respect to one another. In this regard, it will be noted that the interior of each tubular control member 228 is formed with an inwardly extending flange 230 at an outer end thereof. The tubular head member 164 is formed with a narrow rib 232 which extends axially thereon from a position spaced slightly inwardly from each end thereof. The ends of the rib 232 engage flanges 230 to retain the control members 228 axially. The free surface of the rib 232 engages an interior periphery of each control member 228 which has an interior diameter slightly greater than the exterior diameter of the tubular head member 164. The positioning of the axial rib 232 opposite from the elongated section which receives the strips 210 ensures that the opposite side of each control member overlying the strips 210 will be biased radially inwardly.

The interior surface of each tubular control member 228 also is provided with four annularly spaced ribs 234 which slidably engage the exterior periphery of the tubular head member 164 between the lower rib 232 thereof and the opposite surface thereof. Each tubular control member 228 has a portion thereof which constitutes four side-by-side control sections, the axial width of the control sections being slightly greater than the diameter of an O-ring 226 and the arcuate extent being slightly greater than four times the diameter of an O-ring. The control section of each control member which is nearest the adjacent end of the tubular head member 164 has an opening 236 therein which is extends arcuately a distance slightly greater than the diameter of one O-ring 226. The next adjacent control section has an opening 238 aligned with the first opening but with an axial extent which is approximately twice the axial extent of the first. The next has an opening 240 which communicates with the preceding opening but with an axial extent of three times the original size and, finally, the next adjacent control section has an opening 242 which is approximately four times the diameter of an O-ring 226.

It can be seen that, when each tubular control member 228 is rotated to the position shown in which the associated four strip openings 208 are aligned with the openings 236, 238, 240 and 242 in the tubular control member 228, water under pressure within the tubular head member 164 will issue from all of the openings, thus presenting a full fan-shaped spray configuration.

When a tubular control member 228 is turned axially an extent generally equal to the diameter of an O-ring 226, the first control section engages the O-ring 226 of the endmost strip opening 208 to close off the stream issuing therefrom. An additional incremental rotational movement of an arcuate extent slightly greater than an O-ring diameter will bring the second control section into engagement with the second O-ring 226 to close off the stream from the associated strip opening 208. Two more incremental movements of similar axial extent will result in the close-off of the streams issuing from the third and fourth openings 208 from the end of the associated strip 210. By providing a tubular control member 228 at each end, it is possible for the operator to change the spread of the fan-shaped spray into eight different incremental widths by alternately moving each of the control members 228 through an arcuate extent slightly greater than the diameter of an O-ring 226 in succession. Alternatively, either end of the fan-shaped spray pattern can be shortened by moving the associated control member 228 for that end.

DETAILED DESCRIPTION OF THE PREFERRED MANUALLY ADJUSTABLE TIME CONTROL MECHANISM UNIT

Figure 12:
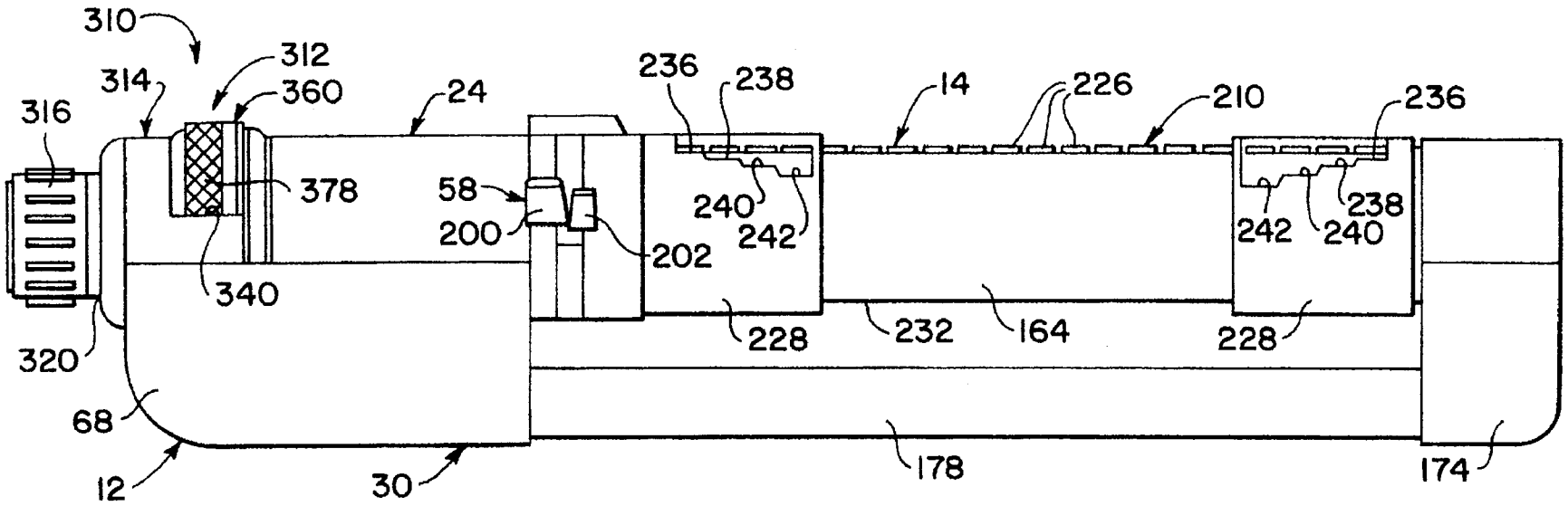
FIG. 12 is a view similar to FIG. 1 of another embodiment of a unitized sprinkler assembly embodying the principles of the present invention.
Figure 13:
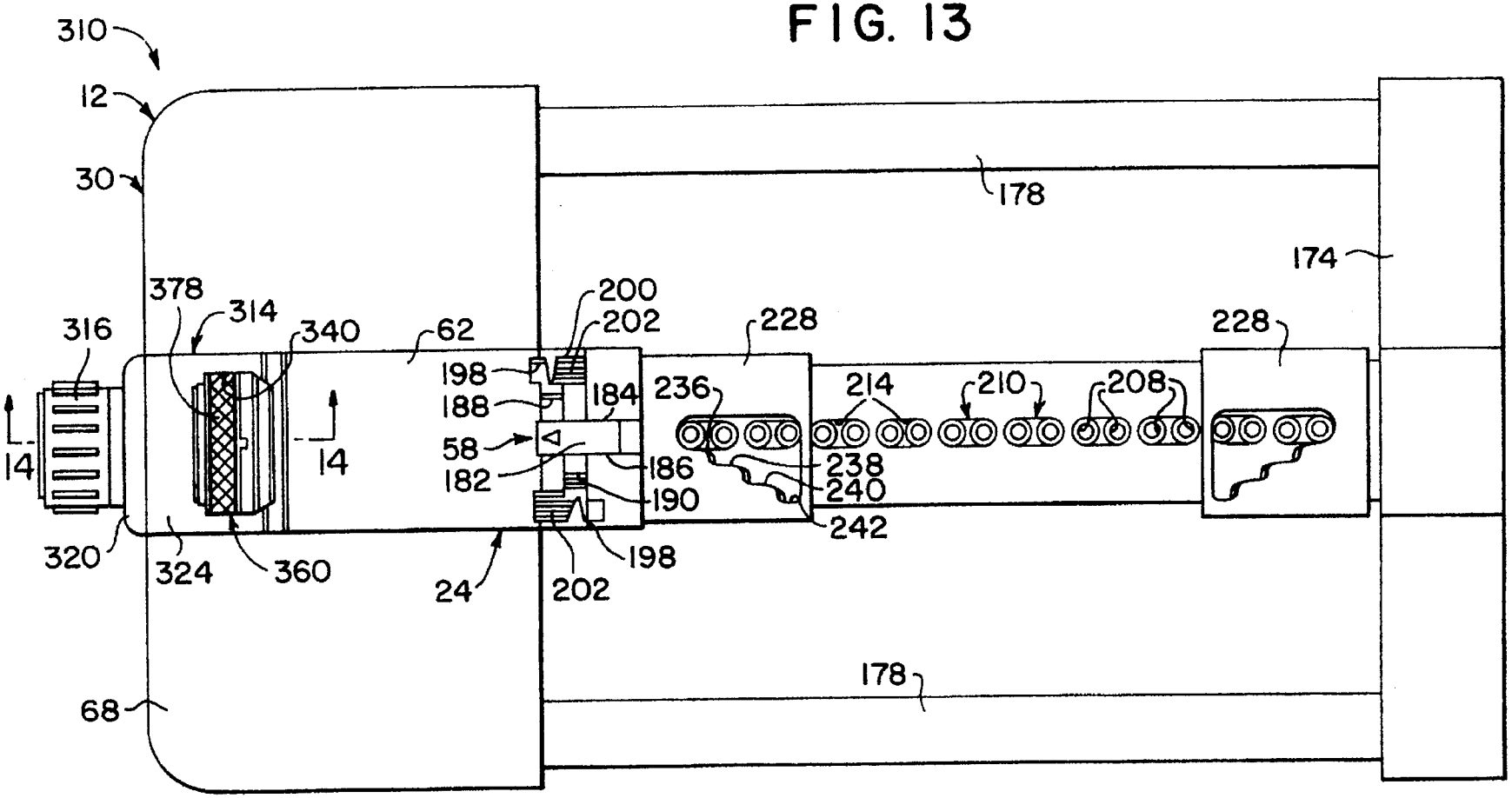
FIG. 13 is a top plan view of the unitized sprinkler assembly shown in FIG. 12.
Figure 14:
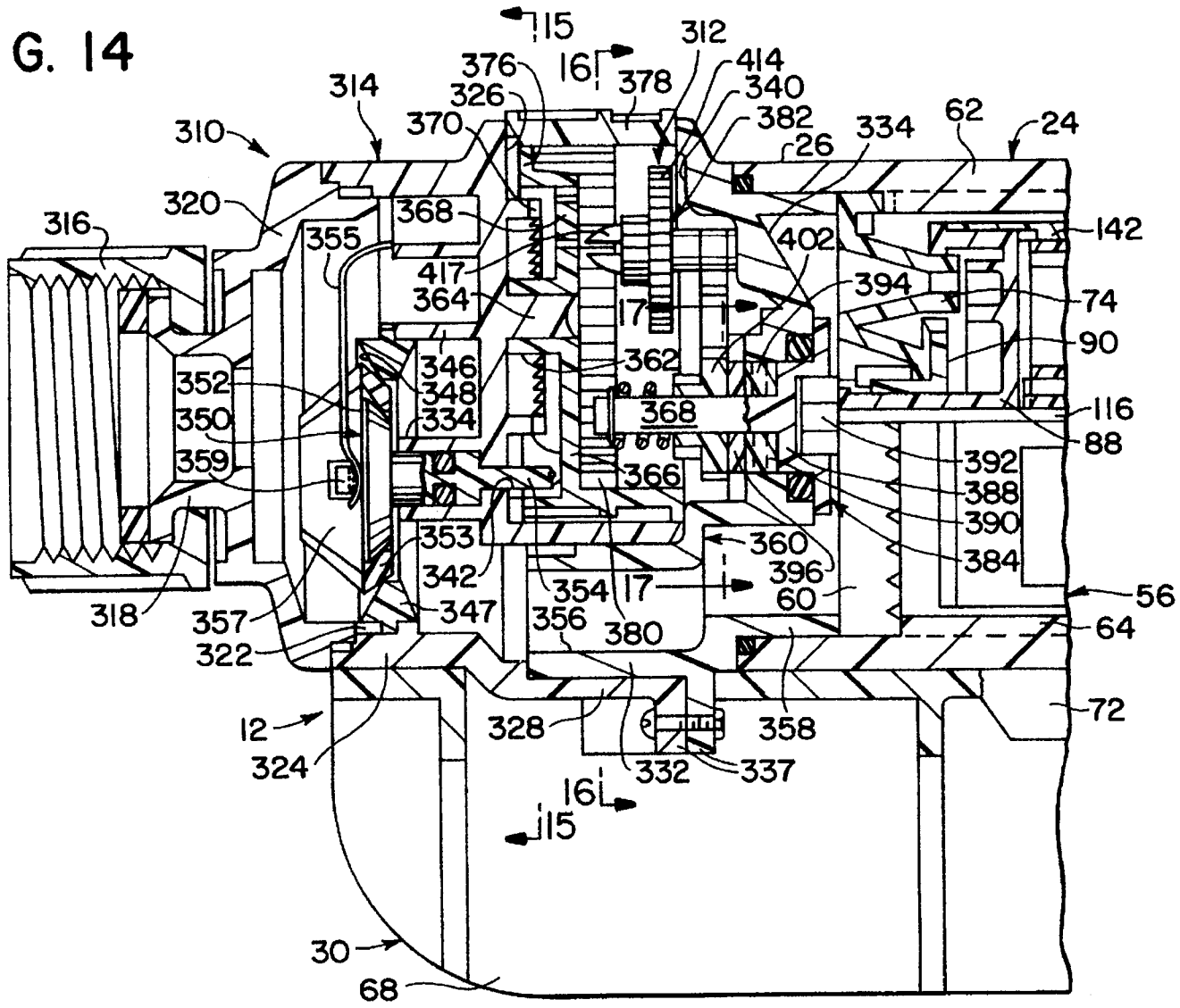
FIG. 14 is an enlarged fragmentary sectional view taken along the line 14—14 of FIG. 13.

Referring now more particularly to FIGS. 12–14, there is shown therein another embodiment of a unitized sprinkler assembly, generally indicated at 310, which embodies the principles of the present invention. Basically, the unitized sprinkler assembly 310 is like the unitized sprinkler assembly 10 previously described except that the first unit of the unitized sprinkler assembly 10 which includes the manually adjustable flow control mechanism 32 and the first housing assembly 16 is replaced by another first unit. The first unit in this embodiment utilizes a manually adjustable control mechanism 312 which is capable of controlling the flow of water under pressure through a first housing assembly, generally indicated at 314, for a manually selected predetermined number of oscillatory movements. While in the broader aspects of the present invention, it would be possible to utilize any known timing mechanism of the type which is adapted to maintain the flow for a manually selected time period, the mechanism 314 described above which is sensitive to the number of oscillatory movements is preferred because this type of timing mechanism is operable to provide a predetermined amount of water per unit area of the stream pattern irrespective of the adjusted size of the pattern.

As best shown in FIGS. 12–14, the first housing assembly 314 consists essentially of four parts. The first part is a female hose coupling element 316 which is rotatably mounted on a flanged tubular inlet portion 318 of the second part which includes an annular wall portion 320 extending generally radially outwardly from the tubular inlet portion 316 and a cylindrical peripheral wall portion 322 extending from the periphery of the annular wall portion 320.

The cylindrical wall portion 322 is adapted to engage within an exterior cylindrical wall portion 324 of the third part. An upstream section of the cylindrical wall portion 324 presents a smooth cylindrical exterior, while a downstream section thereof has an opening 326 in the upper end thereof and a tubular wall extension 328 on the lower end thereof. Formed on the interior surface of the cylindrical wall portion 324 intermediate the sections thereof is an upstream partition wall portion 330 which is also integral with the upper upstream end of the tubular wall extension 328.

Figure 16:
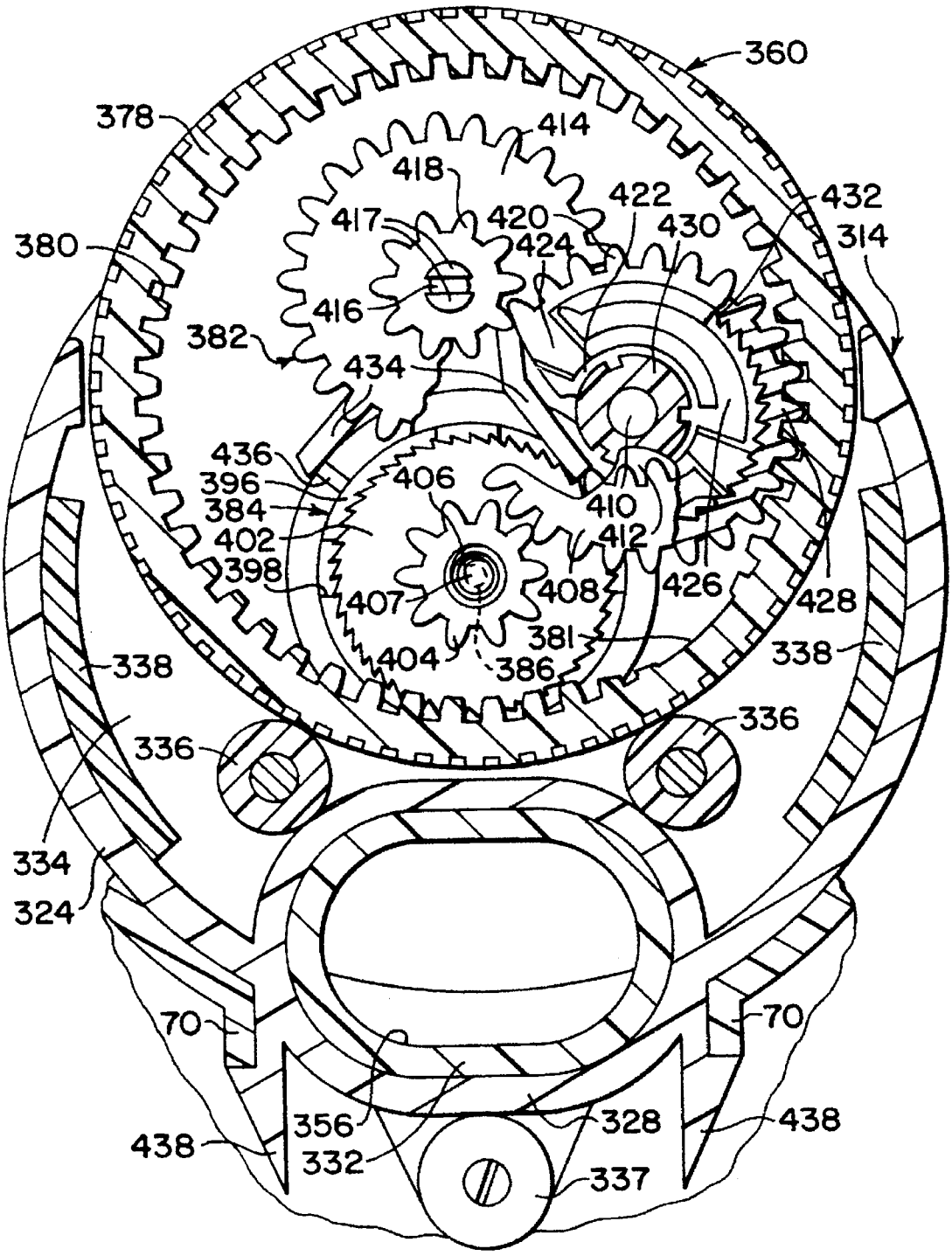
FIG. 16 is an enlarged fragmentary view taken along the line 16—16 of FIG. 14 with certain parts broken away for purposes of clearer illustration.

The final housing part includes a tubular wall portion 332 of a size to engage within the tubular wall extension 328 in telescoping relation therewith and a downstream annular partition wall portion 334 integral with the exterior of downstream end of the tubular wall portion 332. As best shown in FIG. 16, both the upstream partition wall portion and the downstream wall partition portion have integral fastener receiving bosses 336 formed integrally therewith and extending in aligned relation toward one another to receive suitable fasteners which secure the two parts together. In addition, integral lugs 337 are formed in depending relation on the downstream exterior ends of the tubular wall extension and tubular wall portion respectively to receive another suitable securement fastener. The downstream partition wall portion 334 has a pair of arcuate wall sections 338 which engage within the downstream section of the cylindrical wall portion 332 of the third housing part and defines therewith a waterfree cavity 340 within the first housing assembly. The upstream partition wall portion 330 has an opening 342 therein which communicates with the waterfree cavity 340. Extending upstream from the partition wall portion 330 in surrounding relation to the opening 342 is an inner cylindrical wall portion 344 and an outer annular wall portion 346 which surrounds the inner cylindrical wall portion 334. Mounted in the upstream end of the outer annular wall portion 334 is an annular insert 347 which defines an annular valve seat 348.

A water flow valve, generally indicated at 350, is carried by the first housing assembly 314 adjacent the inlet end thereof which is constructed and arranged to be moved between (1) a closed position preventing the flow of water under pressure from the inlet end to the outlet end of the first housing assembly 314 and (2) an open position permitting the flow of water under pressure from the inlet end to the outlet end of the first housing assembly 314. As shown, the water flow valve 350 is an assembly including an inner valve member 352 which includes an intermediate section slidably sealingly engaged within the inner cylindrical wall portion 344 as by an O-ring seal or the like, and a valve stem 354 which extends through the opening 342 into the waterfree cavity 340.

As best shown in FIG. 14, the valve member 352 is adapted to engage an inner valve seat of an annular valve member 353 which, in turn, is adapted to engage the valve seat 348. A leaf spring 355 is fixed at one end to the third housing part within the upper end of the exterior cylindrical wall 324 and has its opposite end engaged with the upstream central surface of the valve member 352. The valve member 352 is connected with the annular valve member 353 by a lost motion connection which allows the valve member 352 to move a small incremental distance off of the seat provided by the annular valve member 353 while the latter is still seated on the valve seat 348. The lost motion connection may be of any suitable construction, however, as shown, the annular valve member 353 includes opposed spaced apertured arcuate wall portions 357 extending upstream thereof and the valve member 352 includes opposed L-shaped lugs 359 on its upstream surface which enter the apertures of the arcuate wall portions 357.

By providing a smaller inner valve member 352 connected to the larger annular valve member 353 by a lost motion connection, the force required to remove the valve assembly 350 from the valve seat 348 is reduced when compared with the force required if the valve member 352 were big enough itself to engage the valve seat 348 since the force required is a function of the inlet pressure and the area of the valve member 352 exposed to the pressure. As soon as the smaller inner valve member 352 moves off of its seat, the inlet pressure is communicated with both sides of the annular valve member 353 so that it can be moved off of the seat 348 by the lost motion connection without having to overcome an imbalance of inlet pressure acting thereon. This action is particularly desirable where the inlet pressure is relatively high.

As best shown in FIG. 14, the outer annular wall portion 346 provides with the telescopically arranged tubular wall extension 328 and tubular wall portion 332 a water flow path 356 which bypasses the waterfree cavity 340 and leads into the outlet end of the first housing assembly 314 which is defined by a cylindrical periphery of an annular wall portion 358 formed integrally on the periphery of the downstream partition wall portion 334 and extending downstream thereof.

Mounted within the waterfree cavity 340 is a valve moving mechanism, generally indicated at 360. The valve moving mechanism 360 is generally constructed and arranged to be manually moved away from a valve-closing position into a selected watering position within a range of watering positions between a minimum watering position and a maximum watering position. The valve moving mechanism 360 is constructed and arranged with respect to the flow control valve to enable the flow control valve to be (1) in the closed position thereof when the valve moving mechanism is in the valve-closing position thereof and (2) in the open position thereof when the valve moving mechanism is within the range of watering positions thereof.

In the preferred embodiment shown, the valve moving mechanism 360 is constructed essentially of a single plastic molding defining a single valve moving member 360 which includes a hub portion 362 rotatably mounted on a shaft 364 which extends integrally from the upstream partition wall portion 330 into the waterfree cavity 340. Extending radially outwardly from the hub portion 362 is a radially extending central wall portion 366. The central wall portion 366 has a 90° segmental opening formed in the periphery thereof within which is disposed an integral resilient pawl portion 368. One end of the pawl portion 368 is integrally connected with the central wall portion 366 and the pawl portion 368 extends arcuately therefrom and axially in a direction downstream so as to engage an annular ratchet structure 370 formed integrally on the upstream partition wall portion 330 and extending into the waterfree cavity 340 so as to be engaged by the end of the resilient pawl portion 368.

Figure 15:
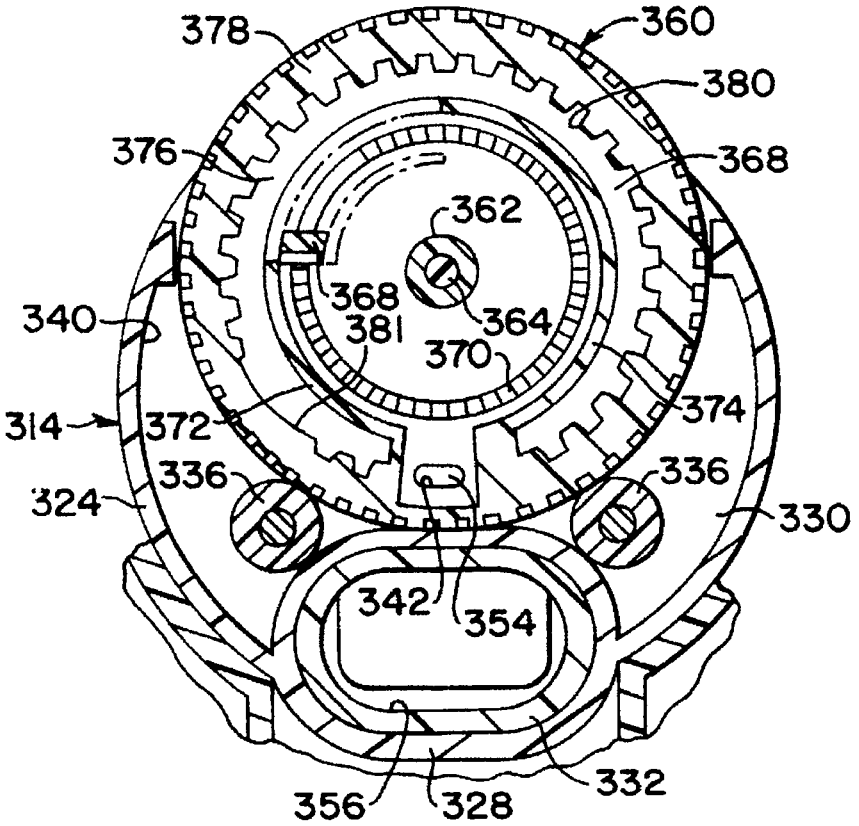
FIG. 15 is a fragmentary view taken along the line 15—15 of FIG. 14.

As best shown in FIG. 15, the annular ratchet structure 370 includes a small flat segment where there are no teeth so that, when the resilient pawl portion 368 is within this area of the annular ratchet structure 370, the valve moving member 360 can be moved in either direction. Beyond the flat segment, the ratchet teeth prevent movement of the valve moving member 360 in a counterclockwise direction as shown in FIG. 15. Clockwise movement is permitted by virtue of the resilient pawl portion 368 being cammed over successive ratchet teeth.

As best shown in FIG. 15, extending from the peripheral edge of the central wall portion 366 at a position adjacent the segmental opening thereof is a first arcuate axially extending wall portion 372 and a second arcuate axially extending portion 374 extends from the opposite edge of the opening along the periphery of the central wall portion 366 and it terminates in a section of diminishing axial extent until it is flush with the adjacent surface of the central wall portion 366 at a position which is spaced from the adjacent end of the arcuate wall portion 372. Formed in integral fashion on the upstream edges of the arcuate wall portions 372 and 374 radially outwardly from the central wall portion 366 is an annular wall portion 376 which includes a short arcuate section between the ends of arcuate wall portions 372 and 374 which is radially aligned with the adjacent periphery of the central radially extending wall portion. From this flat section, the annular wall portion 376 inclines in a direction upstream for an arcuate extent of approximately 30° and thereafter the annular wall portion 376 is fixed in a generally radially extending plane spaced upstream from the plane of the central wall portion 366. At its opposite end, the annular wall portion 376 jogs perpendicularly to complete the annular extent joining with the opposite end of the short initial section.

Extending axially in a direction downstream from the peripheral edge of the annular wall portion 376 is a cylindrical peripheral wall portion 378 having a downstream section of its outer periphery grooved to provide a manual gripping surface and an upstream section relieved to receive a watering guide. The watering guide contains indicia which indicate the off position of the valve-moving member 360, an adjacent on position, and calibrations indicating the inches of water and the hours of application periodically within the range of adjusting positions provided. The interior of the cylindrical peripheral wall portion 378 in the upstream section generally coextensive with the notched exterior section has formed thereon a series of gear teeth which define an interior ring gear 380 of approximately 307° providing a dwell area devoid of gear teeth indicates at 381. The dwell area corresponds with the adjacent on position mentioned above. The interior ring gear 380 forms a part of a motion-transmitting assembly, generally indicated at 382, which serves to transmit the motion from a constant stroke-producing mechanism, generally indicated at 384, to the annular valve-moving member 360.

The constant stroke-producing mechanism 384 includes a shaft 386 which is rotatably mounted near the center of the downstream partition wall portion 334. The mounting structure includes an enlarged exteriorly flanged cylindrical end portion 388 which is integral with one end of the shaft 386. The enlarged end portion 388 is rotatably mounted within an opening 390 formed in the downstream partition wall portion 334 and an annular seal serves to prevent water under pressure from entering the waterfree cavity 340 through the opening 390. The enlarged end portion 388 of the shaft 386 has a hexagonal-shaped recess formed therein which receives in driving relation therewith a nut-like element 392 fixed to the upstream end of the shaft 116 of the oscillating mechanism 56, previously described.

The forward surface of the enlarged end portion 388 of the shaft 386 includes a pair of radially extending ridges which are adapted to engage within corresponding recesses formed in one end of a clutch member 394. The opposite surface of the clutch member 394 has a series of radially extending ridges formed thereon which mate with corresponding ridges formed on a stroke-limiting member 396.

Figure 17:
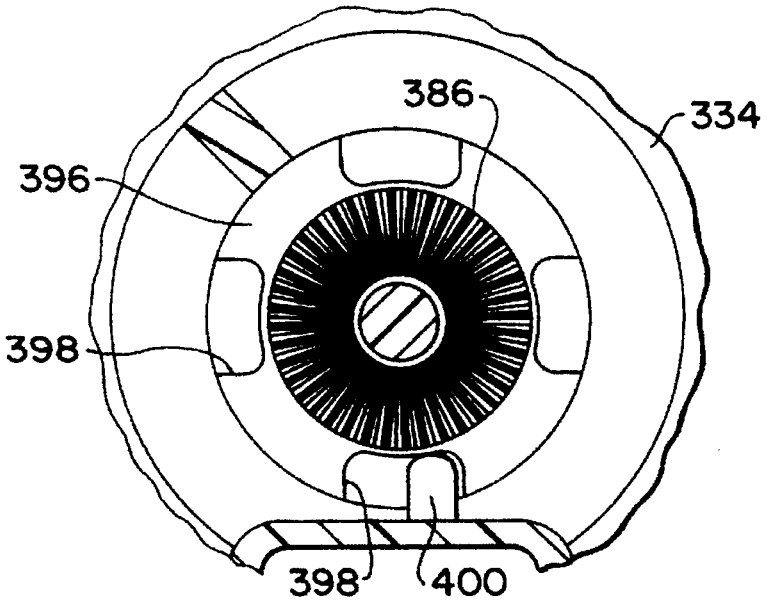
FIG. 17 is an enlarged fragmentary view taken along the line 17—17 of FIG. 14.

As best shown in FIG. 17, the stroke-limiting member 396 has a series of annularly spaced notches 398 formed in the periphery thereof and a lug 400 is formed integrally on the adjacent downstream partition wall portion 334 so as to enter one of the openings 398. The arcuate extent of the openings 398 and the arcuate extent of the lug 400 determine the amount of oscillatory movement that the constant stroke member 396 can be moved through. As best shown in FIGS. 16 and 17, the downstream surface of the constant stroke member 396 is also formed with a series of radially extending ridges and these ridges in turn mate with ridges formed on one surface of a ratchet member 402. The ratchet member 402 has formed integrally on the opposite surface thereof a spur gear 404. The entire set of members 394, 396 and 402, all of which are mounted on the shaft 386, are resiliently urged into abutting engagement by a coil spring 406 one end of which engages the spur gear 404 and the other end of which is fixed to the free end of the shaft 386, as by a cap 407.

The spur gear 404 forms a component of the aforesaid motion-transmitting mechanism 382 which also includes a large spur gear 408 disposed in meshing relation with the small spur gear 404. The large spur gear 408 is rotatably mounted on a shaft 410 formed integrally on the downstream partition wall portion 334 and extending therefrom into the waterfree cavity 340. The large spur gear 408 has integrally formed therewith a small spur gear 412 which in turn meshes with a large spur gear 414 rotatably mounted on a second shaft 416 integrally formed on the downstream partition wall portion 334 and extending therefrom into the waterfree space 340. Shaft 416 has its free end split and enlarged, as indicated at 417, to enable the components mounted thereon to be snapped thereover and retained thereon. The large spur gear 414 also has a small spur gear 418 integral therewith and this small spur gear 418 meshes with a spur gear 420 having a special interior construction. The interior construction includes a hub portion 422 having a pair of integral arms 424 which connect with an annular rim on which the gear teeth are formed. Extending from the hub portion 422 in axially spaced relation from the annular ring which defines the gear teeth is a pair of resilient pawl elements 426 each of which is integral at one end with the hub portions 422 and extends arcuately therefrom with a free end formed in a ratchet engaging configuration. Mounted on the shaft 410 over the special spur gear 420 is a final spur gear 428 which includes a hub section 430 journalled on the shaft 410 and extending within the enlarged hub portion 422 of the special spur gear 420. The final spur gear 428 also includes an annular section which provides the teeth which mesh with the interior ring gear 380 formed on the valve moving member 360. Formed on the interior of the annular section of the final spur gear 428 is a series of ratchet teeth 432 which are adapted to be engaged by the free ends of the two resilient pawl elements 426 provided by the special spur gear 420.

It will also be noted from FIGS. 14 and 16 that there is mounted on the shaft 416 between the downstream partition wall portion 334 and the spur gear 414 a pawl member 434 which includes a hub portion and two arms extending outwardly therefrom in diverging relation. One of the arms is disposed to engage a lug 436 formed integrally on the downstream partition wall portion 334 and the other arm is adapted to engage the ratchet teeth provided on the ratchet member 402.

It will be understood that the first housing assembly 314 is mounted with respect to the second housing assembly 24 and the base assembly 30 in the same way as the first housing assembly 16 previously described is mounted therein. Specifically, the peripheral wall portion 358 is disposed within and secured to the inlet end 26 of the peripheral housing wall 62 as is shown in FIG. 14. As best shown in FIG. 16, the first housing assembly 314 includes two barb-like extensions 438 formed integrally on the interior periphery of the cylindrical wall portion 324 which map in under the edges of the flanges 70 defining the opening in the base member 68.

The manually adjustable timer control mechanism 312 operates in the following manner. In the inoperable or off position of the valve moving member 360, the valve stem 354 is disposed in alignment with the flat section of the annular wall portion 378 which is aligned with the central wall portion 368. The valve 350 is disposed in engagement with the valve seat 348 and water under pressure within the inlet end of the first housing assembly 314 acts on the valve member 352 to retain it in its closed position. The operation of the mechanism 312 is initiated by the operator manually grasping the exterior grooved section of the valve moving member 360 and turning the same in a clockwise direction as viewed in FIG. 15 (a counter clockwise direction as viewed in FIG. 16). When the valve moving member 360 is rotated a distance sufficient to fully open the valve 350 in the manner previously described, the on position is then indicated in the exterior section of the walled portion 378. In this position, the spur gear 420 is disposed in the dwell area 381 so that it is possible to operate the sprinkler at this setting without the timer being operated since the driving connection for the timer is disrupted. In most instances, the valve moving member 360 will be moved beyond the on position. As the valve moving member is further rotated, the calibrations in the downstream exterior section of the walled portion 378 read out the maximum amount of water coverage and the maximum amount of hours that are within the range of the watering positions provides. For example, the first indication of inches may be ⅜th with a corresponding indication of 3 hours. When these indicia are uppermost, the unit will operate to apply ⅜th of an inch of water to the water pattern irrespective of its size and it will take approximately three hours to accomplish the application. The indications may be at various intervals as, for example, each ⅛th, each and each one hour, with a last being ½ hour.

It will be noted that, during the first approximately 45° of movement of the valve moving member 360, the ramp section of the annular wall 368 will engage the end of the valve stem 354 and move the valve member 352 in an upstream direction. As soon as the valve member 352 leaves the valve seat provided by the annular valve 353, the water under pressure in the inlet end of the first housing assembly 314 is allowed to enter the annular wall portion 346 to equalize the pressure on both sides of the annular valve member 353. Continued movement of the valve member 353 will, by virtue of the lost motion connection with the annular valve member, carry the annular valve 353 off of its seat 348. The water under pressure which entered the annular wall portion 345 passes through the by-pass opening 356 and into the outlet end of the first housing assembly 314 which is connected in water pressure communicating relation with the inlet end 26 of the second housing assembly 24. As the water under pressure passes through the second housing assembly 24, the oscillating mechanism 56 is operable to effect a turning movement of sprinkler head assembly 14 in one direction. The constant stroke producing mechanism 384 is turned with the sprinkler head assembly 14 by virtue of the turning of the shaft 116 and the nut like element 392, which is connected to the upstream end of the shaft 116. A turning movement of the nut like element 392 operates directly to move the shaft 386 in one direction, which can be conveniently considered to be a clockwise direction as viewed in FIG. 16. This movement of the shaft 386 is transmitted to the clutch member 394 by virtue of ridge and groove connection of the shaft end portion 388 therewith, which is maintained by the spring 406. The turning movement of the clutch member 394 with the shaft 386 will, in turn, effect a turning movement of the constant stroke member 396 in the same direction by virtue of the inter-engaging ridges therebetween and the action of the spring 406.

As best shown in FIG. 17, the constant stroke member 396 can only move a limited distance in the clockwise direction shown a portion wherein the lug 400 is in engagement with the left hand edge of the slot 398 before the lug 400 engages the opposite wall of the slot 398 as shown. During this movement a ratchet member 402 is moved with the constant stroke member 396 by virtue of the inner-engaging ridges therebetween and the action of the spring 406. The continued rotational movement imparted to the shaft 386 by the continued clockwise movement of the sprinkler head assembly 14 will be transmitted to the clutch member 394. However, since the constant stroke member 396 can no longer move in a clockwise direction, the ratchet member 402 likewise will not thereafter be moved during the clockwise oscillatory stoke of that oscillating cycle of the sprinkler head assembly 14. Therefore, the only clockwise stroke movement which is transmitted to the valve moving member 360 by the motion transmitting assembly 382 will be the initial clockwise movement of the ratchet member 402 with the constant stroke member 396.

In this regard, it will be noted that the motion transmitting assembly 382 is operable to transmit the motion of the ratchet member 402 by virtue of the small spur gear 404 which is fixed to the ratchet member 402, the meshing of large spur gear 408 with the small spur gear 404, the movement of small spur gear 412 with the large gear 404 which is fixed thereto, the meshing of large spur gear 414 with the small spur gear 412, the movement of the small spur gear 418 with the large spur gear 414 which is fixed thereto, the meshing of special spur gear 420 with small spur gear 418 and the movement of the final spur gear 428 with the special spur gear 420 by virtue of the inner-engagement of the resilient pawl elements 426 with the ratchet teeth 432 of the final gear 428 which meshes with the ring gear 380 on the valve moving member 360.

It will also be noted that, during the initial manual movement of the valve moving member 360 from the off position to the valve opening position, which begins the range of watering positions, the final spur gear 420 will be moved by the manual movement of the valve moving member 360, but this counter-clockwise movement of the final gear 428 will not be transmitted back through the motion transmitting assembly to the ratchet member 402, but rather will result merely in the resilient pawl elements 426 riding over the ratchet teeth 432 of the final gear 428. Also as best shown in FIG. 15, as soon as the water setting range of the valve moving member 360 has been reached, the resilient pawl element 368 of the valve moving member 360 will reach the ratchet teeth 370 thus preventing the reverse movement of the valve moving member 360 about its rotational axis provided by shaft 364. When the clockwise stroke of the first cycle has been completed by virtue of the arm surface 186 engaging the stop surface 190, the reversing mechanism 56 is operable in the manner previously described to commence the return stroke of the sprinkler head assembly 14 in a counterclockwise direction. During this return stroke, the shaft 386 will be rotated in a counterclockwise direction as shown in FIG. 16 but movement of the ratchet member 402 will take place therewith the engagement of the pawl arm 434 therewith prevents such movement. Consequently, during the return stroke, the clutch member 394 will initially only move the constant stroke member back into its initial positions and thereafter the clutch member 394 will slip with respect to the constant stroke member 396 a well as the ratchet member 402 by virtue of the clutching action provided by the inner-engaging ridge surfaces and the spring 406.

In this way, during each oscillatory cycle of the sprinkler head assembly 14, the ratchet member 402 will have only a small constant stroke movement in the clockwise direction as reviewed in FIG. 16, which movement is transmitted by the motion transmitting assembly 382 to move the valve moving member 360 in a counterclockwise direction as shown in FIG. 16. When a sufficient number of oscillatory cycles have been completed to affect incremental movement of the valve moving member 360 in a clockwise direction as shown in FIG. 15 so that the initial flat section of the annular wall 368 passes beyond the end of the valve stem 354, the water pressure acting on the valve 350 will serve to close the valve member 52 against the valve seat 348 which shuts off the flow of water under pressure from the inlet end of the first housing assembly 314 through the bypass path 356. It is significant to note that it is essentially the number of oscillatory cycles which determines the watering time not the amount of water flow which will take place within the watering time. Thus criteria for determining watering time insures that a predetermined amount of water will be distributed to the watering pattern irrespective of the area of the watering pattern selected by virtue of the setting of the adjusting mechanism 58.

DETAILED DESCRIPTION OF PREFERRED PART CIRCLE ROTARY UNITIZED SPRINKLER ASSEMBLY

Figure 18:
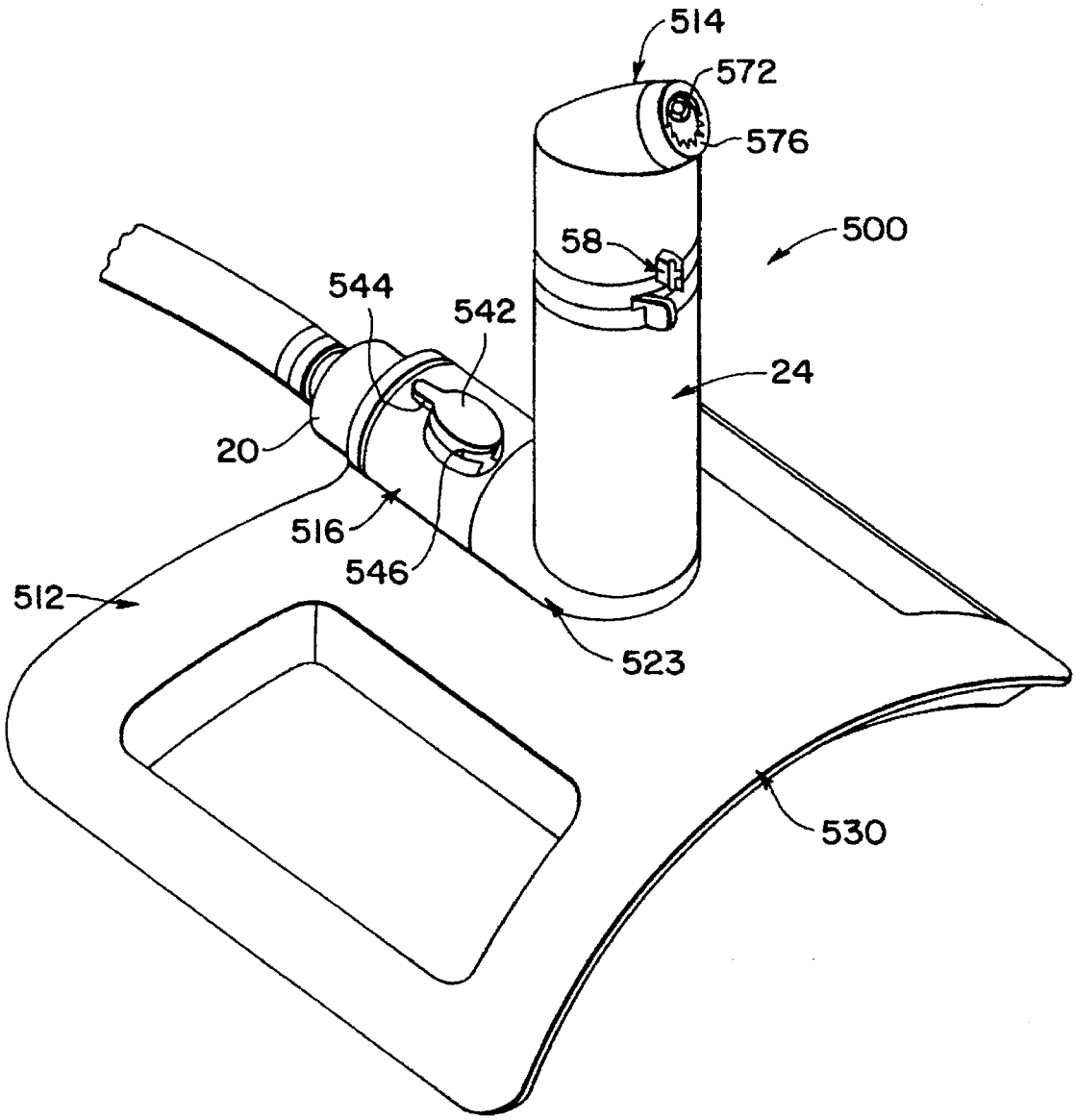
FIG. 18 is a perspective view of still another embodiment of a unitized sprinkler assembly embodying the principles of the present invention.
Figure 20:
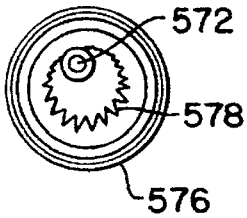
FIG. 20 is a face view of the outlet end of the sprinkler head assembly utilized in the unitized sprinkler assembly shown in FIG. 18.
Figure 19:
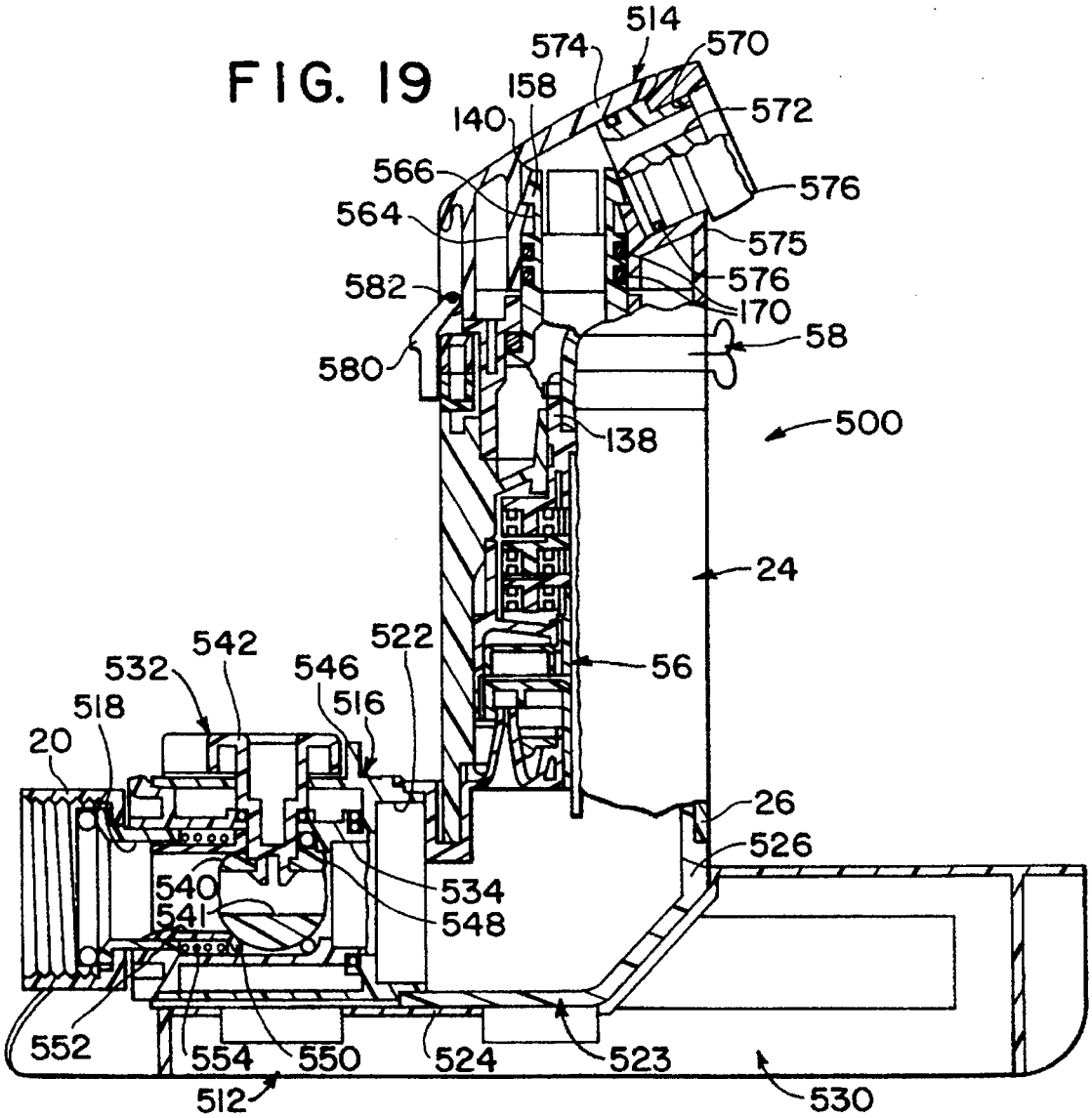
FIG. 19 is a partial vertical sectional view of the unitized sprinkler assembly shown in FIG. 12.

Referring now more particularly to FIGS. 18–20, there is shown therein another embodiment of a unitized sprinkler assembly, generally indicated at 500, which embodies the principles of the present invention. Sprinkler assembly 500 is a part circle rotary unitized sprinkler assembly and includes a housing and base assembly, generally indicated at 512, and a sprinkler head assembly, generally indicated at 514, mounted on the base and housing assembly 512 for movement about an oscillatory axis through repeated oscillating cycles, each of which includes a forward stroke in one direction and a return stroke in the opposite direction. In the embodiment shown, the housing and base assembly 512 includes a first housing assembly, generally indicated at 516, which includes an inlet and 518, defined by a conventional female hose coupling element 20 and a spaced outlet end 522. An intermediate housing assembly, generally indicated at 523, includes an inlet end 524 disposed in water communicating relation with respect to the outlet end 522 of the first housing assembly 516, and an outlet end 526 which communicates with an inlet end of the second housing assembly, generally indicated at 24. In FIG. 19, outlet end 526 of the intermediate housing assembly 523 is in water communicating relation with respect to inlet end 26 of the second housing assembly 24. The intermediate housing assembly 523 can be considered to be an extension of the outlet 522 of the first housing assembly 516 or an extension of the inlet 26 of the second housing assembly 24. A base assembly, generally indicated at 530, has a fixed snap action connection with the first and intermediate housing assemblies 516 and 523 respectively and is constructed and arranged to support the sprinkler assembly 500 on a lawn.

Mounted within the first housing assembly 516 is a manually adjustable flow control mechanism, generally indicated at 532. The flowcontrol mechanism 532 and the first housing assembly 516 within which it is mounted constitutes a first unit of the unitized sprinkler assembly 500 of the present invention.

The flow control mechanism 532, shown in FIGS. 18 and 19, is in the form of a moveable ball valve structure which includes a central moveable ball member 540 having an axial channel 541 therethrough and a digitally engageable handle 542. The handle 542 extends radially outwardly from the first housing assembly 516.

The flow control structure 535 is assembled in moveable operative relation with the first housing assembly 516 by moving the handle 542 so as to rotate the ball member 540 within housing wall 534. The handle may be rotated between a fully opened position, as shown in FIGS. 18 and 19, whereby water may flow through channel 541, to a closed position whereby protrusion 544 engages within stop surface 546 of the first housing assembly 516 which disposes the channel 541 generally transverse to the flow direction, thereby preventing flow through the ball valve structure. It can be appreciated that handle 542 may be rotated within any position between fully opened and fully closed so orient the channel 541 to control flow through the first housing assembly 516. The flow control mechanism 532 comprises a conventional ball valve including the ball valve member 540 which is rotatable with respect to wall 534. The flow control mechanism 532 includes a plunger assembly generally indicated at 550, comprising a plunger member 552 which is biased by spring 554. The plunger assembly 550 assists in low pressure shut-off of the flow control mechanism 532. The plunger assembly 552 need not be provided if the shut-off pressure is approximately 15 psi or greater.

It will be understood that the flow control mechanism 532 can be utilized in the wave sprinkler assembly 10 in lieu of the flow control mechanism 32 previously described. Conversely, the flow control mechanism 32 can be utilized in lieu of the flow control mechanism 532 in sprinkler assembly 500.

As shown in FIG. 19, mounted in the second housing assembly 24 is an oscillating mechanism 56 which constitutes the second unit of the unitized sprinkler assembly 500. The oscillating mechanism 56 is identical to the mechanism disclosed in FIG. 3, thus, the detailed description thereof need not be repeated here.

In accordance with the principles of the present invention, the oscillating mechanism 56 is constructed and arranged to be operable by the flow of water under pressure between the inlet 26 to move the sprinkler spray head assembly 514 through repeated oscillating head cycles thereof during which water under pressure is discharged from the sprinkler assembly 514 and distributed in a predetermined part circle pattern on the ground. Each of the oscillating head cycles includes a head stroke in one direction and a return head stroke in the opposite direction as described above. A stop system 58 is provided for adjusting the distance of the head stroke of each head cycle within a range between a minimum head stroke distance and a maximum head stroke distance so as to vary the corresponding dimension of the water pattern within a range between a minimum dimension and a maximum dimension.

As in the wave type sprinkler assembly 10 described above, the output shaft 138 is connected with the sprinkler head assembly 514 which constitutes a third unit of the unitized sprinkler assembly 500 embodying the principles of the present invention. Preferably, the connection of the shaft 138 with the sprinkler head assembly 514 is made via a slip clutch connecting member, generally indicated at 140 so as to be moved through repeated oscillating cycles therewith. As previously indicated, the cycle stroke distance is determined by the setting of the stop system or adjusting mechanism 58. In this regard, the sprinkler head assembly 514 includes an elongated tubular head member 564 having an annular wall 566 extending radially inwardly or shown in FIG. 19. The tubular head member 564 is adapted to be connected to the connecting member 140 by simply moving the same axially over pronged like elements 158 at the downstream end of the connecting member 140 until the inner peripheral of the annular wall 566 engages behind the flanges of the elements 158 which flex to permit the connection with a snap action.

Referring now more particularly to FIGS. 19 and 20, the sprinkler spray head assembly 514 is provided with a nozzle 570 defining a flow channel 572 therethrough. The nozzle 570 is fitted into a tubular head portion 574 which extends outwardly from the tubular member 564. The nozzle 570 is provided with a key which cooperates with a groove provided in the tubular head 574 for fixing the nozzle with the tubular head 574. An O-ring 576 is provided for sealing the tubular head 574 with the nozzle. A manually moveable deflector 576 is mounted on a downstream end of the nozzle 570. The deflector 576 is fitted into an annular groove of the nozzle 570 so as to be rotatable with respect thereto. As shown in FIG. 20, the moveable deflector 576 includes a plurality of radially inwardly extending protrusions 578 such that upon rotating the moveable deflector, the protrusion 578 maybe moved so as to partially cover the flow channel 572 thereby shaving-off a portion of the flow of water therethrough so as to ensure that a portion of the flow may be directed radial distance closer to the sprinkler assembly 500 than that of the main stream of water discharged from the flow channel 572. The part circle rotary sprinkler assembly 500 is constructed to discharge water under pressure fed thereto in an upwardly and outwardly mainstream and a secondary stream is provided by the closing-off a portion of the flow channel.

The upstream end of the tubular head 574 includes an arm 580 coupled thereto at hinge 582. When in a lowermost position (FIG. 19) the arm 580 provides stop surfaces which engage stop surfaces of the adjusting mechanism 58. When the arm 580 is pivoted to its uppermost position, it will not contact the adjusting mechanism 58, thus providing full circle operation in one direction.

It can be appreciated that the part circle rotary unitized sprinkler assembly 500 advantageously provides a flow control mechanism 532 or 32 which can be shut-off at the sprinkler after a predetermined amount of water has been delivered based upon an adjustable manual setting.

Further, it can be appreciated that in lieu of the manual flow control mechanism 532, the first unit of the unitized sprinkler assembly 500 may be of the adjustable time-control type control mechanism 312.

Although a hose-type part circle rotary unitized sprinkler assembly has been shown in FIGS. 18–20, which is placed on a lawn for delivering a predetermined amount of water thereon, it can be appreciated that an internal drive pop-up type adjustable part circle sprinkler unit can be provided utilizing the second housing assembly 24 together with the sprinkler head assembly 514.

Any U.S. patent applications or patents mentioned or cited hereinabove are hereby incorporated by reference into the present specification.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A unitized sprinkler assembly comprising a first housing assembly having an inlet end constructed and arranged to be connected with a source of water under pressure and a spaced outlet end, a second housing assembly having an inlet end and a spaced outlet end, the inlet end of said second housing assembly being constructed and arranged to mate with the outlet end of said first housing assembly and being connected in water pressure communicating relation therewith, a manually adjustable control mechanism carried by said first housing assembly between the inlet end and outlet end thereof constructed and arranged to control the flow of water under pressure from the inlet end thereof to the outlet end thereof in accordance with the manual adjustment of said manually adjustable control mechanism, a sprinkler head assembly having an inlet end disposed to receive water under pressure flowing from the outlet end of said second housing assembly, a base assembly constructed and arranged to support all of said assemblies on a ground area to be sprinkled and having said assemblies disposed in supported relation thereon, a structural connection between said sprinkler head assembly and said second housing assembly constructed and arranged to enable said sprinkler head assembly to oscillate about an oscillatory axis with respect to said second housing assembly, an oscillating mechanism mounted in said second housing assembly constructed and arranged to be operated by the flow of water under pressure between the inlet end and outlet end of said second housing assembly and connected with said sprinkler head assembly to oscillate said sprinkler head assembly about said oscillatory axis through repeated oscillating head cycles, said sprinkler head assembly being constructed and arranged to discharge water under pressure flowing through the inlet end thereof in a predetermined stream configuration so as to be distributed on the ground to be sprinkled in a predetermined water pattern determined by the oscillating head cycle thereof, each of said oscillating head cycles including a head stroke in one direction and a return head stroke in the opposite direction so that a corresponding dimension of said water pattern corresponds with the distance of the head stroke of each oscillating head cycle, and an adjusting mechanism constructed and arranged to enable the distance of the head stroke of each oscillating head cycle to be adjusted within a range between a minimum head stroke distance and a maximum head stroke distance so as to vary the corresponding dimension of said water pattern within a range between a minimum dimension and a maximum dimension.

2. A unitized sprinkler assembly as defined in claim 1 wherein said first housing assembly includes a peripheral wall portion extending axially between said inlet end and said outlet end, said manually adjustable control mechanism including a cam slot formed in said peripheral wall portion to extend from one end thereof peripherally to an opposite end thereof displaced axially from the one end thereof a distance substantially less than the peripheral distance between the ends thereof, an inlet cylindrical wall communicating in water pressure relation with said first housing inlet end extending axially within an inlet end of said peripheral wall portion, an outlet cylindrical wall communicating with said first housing assembly outlet end extending axially within an outlet end of said peripheral wall portion, a movable cylindrical wall having opposite end portions disposed in sealed telescoping relation with said inlet and outlet cylindrical walls, a handle fixed with respect to said movable cylindrical wall and extending within said cam slot outwardly thereof in a position to be manually engaged, said handle being constructed and arranged with respect to said cam slot to be guided axially by said cam slot when manually moved through a peripheral extent thereof so that the axial position of said handle within said cam slot determines the axial position of said movable cylindrical wall in telescoping relation with said input and output cylindrical walls, said movable cylindrical wall and one of said input and output cylindrical walls having cooperating flow control surfaces movable relatively axially toward and away from one another as said movable cylindrical wall is moved axially with the handle in response to a manual peripheral movement thereof, said cooperating flow control surfaces being constructed and arranged to vary the flow from said inlet through said cylindrical walls to said outlet in accordance with the position of said handle within said cam slot.

3. A unitized sprinkler assembly as defined in claim 2 wherein said oscillating mechanism comprises a water jet and impeller reversing assembly within said second housing assembly which includes a movable member constructed and arranged to be moved between first and second positions, a rotatable impeller, structural surfaces for directing a continuous supply of water under pressure from the inlet end of said second housing assembly in jet formation onto said impeller to rotate the same, and a rotatable output member, the arrangement being such that when said movable member is in said first position said output member is connected to be rotated by the rotation of said impeller in one direction and when said movable member is in said second position said output member is connected to be rotated by the rotation of said impeller in an opposite direction, a planetary gear assembly mounted within said second housing assembly comprising a multiplicity of gears including coaxial sun and ring gears and carrier mounted planetary gears in meshing relation between coaxial sun and ring gears, one of said ring gears being a movable ring gear mounted within said second housing assembly to be moved arcuately about an axis thereof between first and second positions, said movable ring gear being connected with the movable member to move said movable member (1) from the first position thereof into the second position thereof when said movable ring gear is moved from the first position thereof to the second position thereof and (2) from the second position of said movable member into the first position thereof when said movable ring gear is moved from the second position thereof into the first position thereof, said multiplicity of gears including an input gear connected to be moved about the axis of said movable ring gear by the rotatable output member and an output gear movable about the axis of said ring gear and connected to move said sprinkler head assembly about the oscillating axis thereof in a direction corresponding to the direction of movement of said output gear, said adjusting mechanism including a stop system acting between said sprinkler head assembly and said second housing assembly constructed and arranged to determine first and second stopping positions for said sprinkler head assembly, the arrangement being such that said sprinkler head assembly is moved about the oscillating axis thereof (1) in a direction toward said first stopping position when said movable ring gear is retained in the first position thereof with said rotatable output member rotating in said one direction and said input and output gears moving in directions corresponding thereto so that when said sprinkler head assembly reaches said first stopping position the movement of the sprinkler head assembly is stopped while the continued rotation of the rotatable output member in said one direction and the corresponding movement of said input gear cause said ring gear to be moved about its axis from the first position thereof to the second position thereof and (2) in an opposite direction toward said second stopping position when said movable ring gear is retained in the second position thereof with said rotatable output member rotating in said opposite direction and said input and output gears moving in directions corresponding thereto so that when said sprinkler head assembly reaches said second stopping position the movement of the sprinkler head assembly and output gear is stopped while the continued rotation of the rotatable output member in said opposite direction and the corresponding movement of said input gear cause said movable ring gear to be moved about its axis from the second position thereof to the first position thereof.

4. A unitized sprinkler assembly as defined in claim 3 wherein said adjusting mechanism includes first and second side-by-side adjusting rings mounted on an annular housing section of said second housing assembly constructed and arranged to be moved into first and second selected adjustment positions within first and second ranges of adjustment positions, said first and second rings having first and second fixed stop surfaces thereon disposed in arcuately spaced relation to one another when said rings are in first and second selected adjustment positions, said sprinkler head assembly having cooperating first and second stop surfaces thereon disposed in a position to engage said fixed first and second stop surfaces at the end of each head stroke and return stroke of said sprinkler head assembly respectively, said first and second rings each being split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof, said annular housing section having a series of outwardly facing serrations on the exterior surface thereof of a size and shape to mesh with the plurality of serrations of said arcuate sections, said first and second rings each being constructed and arranged to be moved from any first or second selected adjustment position respectively to any other first or second selected adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of said annular housing section.

5. A unitized sprinkler assembly as defined in claim 1 wherein said manually adjustable control mechanism comprises a water flow valve carried by said first housing assembly adjacent the inlet end thereof constructed and arranged to be moved between (1) a closed position preventing the flow of water under pressure from the inlet end to the outlet end thereof and (2) an open position permitting the flow of water under pressure from the inlet end to the outlet end thereof, a valve-moving mechanism carried by said first housing assembly constructed and arranged to be manually moved away from a valve-closing position into a selected watering position within a range of watering positions between a minimum watering position and a maximum watering position, said valve-moving mechanism being constructed and arranged with respect to said flow control valve to enable the flow control valve to be (1) in the closed position thereof when said valve-moving mechanism is in the valve-closing position thereof and (2) in the open position thereof when said valve-moving mechanism is within the range of watering positions thereof, a constant stroke producing mechanism carried by said first housing assembly including an oscillating input member connected with said oscillating mechanism to be moved thereby through repeated oscillating input cycles corresponding to the repeated oscillating head cycles said sprinkler head assembly is moved by said oscillating mechanism and a constant stroke output member constructed and arranged to produce a movement stroke of a constant distance for each head cycle irrespective of the stroke distance within said range of stroke distances of each head cycle, and a motion-transmitting assembly carried by said first housing assembly constructed and arranged to transmit the movement strokes of said constant stroke output member to said valve-moving mechanism to move said valve-moving mechanism from a selected watering position within said range of watering positions into said valve-closing position so that the amount of water delivered to the water pattern per unit area is determined by the selected watering position irrespective of the corresponding dimension of the pattern within said range of dimensions.

6. A unitized sprinkler assembly as defined in claim 5 wherein said oscillating mechanism comprises a water jet and impeller reversing assembly within said second housing assembly which includes a movable member constructed and arranged to be moved between first and second positions, a rotatable impeller, structural surfaces for directing a continuous supply of water under pressure from the inlet end of said second housing assembly in jet formation onto said impeller to rotate the same, and a rotatable output member, the arrangement being such that when said movable member is in said first position said output member is connected to be rotated by the rotation of said impeller in one direction and when said movable member is in said second position said output member is connected to be rotated by the rotation of said impeller in an opposite direction, a planetary gear assembly mounted within said second housing assembly comprising a multiplicity of gears including coaxial sun and ring gears and carrier mounted planetary gears in meshing relation between coaxial sun and ring gears, one of said ring gears being a movable ring gear mounted within said second housing assembly to be moved arcuately about an axis thereof between first and second positions, said movable ring gear being connected with the movable member to move said movable member (1) from the first position thereof into the second position thereof when said movable ring gear is moved from the first position thereof to the second position thereof and (2) from the second position of said movable member into the first position thereof when said movable ring gear is moved from the second position thereof into the first position thereof, said multiplicity of gears including an input gear connected to be moved about the axis of said movable ring gear by the rotatable output member and an output gear movable about the axis of said ring gear and connected to move said sprinkler head assembly about the oscillating axis thereof in a direction corresponding to the direction of movement of said output gear, said adjusting mechanism including a stop system acting between said sprinkler head assembly and said second housing assembly constructed and arranged to determine first and second stopping positions for said sprinkler head assembly, the arrangement being such that said sprinkler head assembly is moved about the oscillating axis thereof (1) in a direction toward said first stopping position when said movable ring gear is retained in the first position thereof with said rotatable output member rotating in said one direction and said input and output gears moving in directions corresponding thereto so that when said sprinkler head assembly reaches said first stopping position the movement of the sprinkler head assembly is stopped while the continued rotation of the rotatable output member in said one direction and the corresponding movement of said input gear cause said ring gear to be moved about its axis from the first position thereof to the second position thereof and (2) in an opposite direction toward said second stopping position when said movable ring gear is retained in the second position thereof with said rotatable output member rotating in said opposite direction and said input and output gears moving in directions corresponding thereto so that when said sprinkler head assembly reaches said second stopping position the movement of the sprinkler head assembly and output gear is stopped while the continued rotation of the rotatable output member in said opposite direction and the corresponding movement of said input gear cause said movable ring gear to be moved about its axis from the second position thereof to the first position thereof.

7. A unitized sprinkler assembly as defined in claim 6 wherein said adjusting mechanism includes first and second side-by-side adjusting rings mounted on an annular housing section of said second housing assembly constructed and arranged to be moved into first and second selected adjustment positions within first and second ranges of adjustment positions, said first and second rings having first and second fixed stop surfaces thereon disposed in arcuately spaced relation to one another when said rings are in first and second selected adjustment positions, said sprinkler head assembly having cooperating first and second stop surfaces thereon disposed in a position to engage said fixed first and second stop surfaces at the end of each head stroke and return stroke of said sprinkler head assembly respectively, said first and second rings each being split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof, said annular housing section having a series of outwardly facing serrations on the exterior surface thereof of a size and shape to mesh with the plurality of serrations of said arcuate sections, said first and second rings each being constructed and arranged to be moved from any first or second selected adjustment position respectively to any other first or second selected adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of said annular housing section.

8. A unitized sprinkler assembly as defined in claim 1 wherein said oscillating mechanism comprises a water jet and impeller reversing assembly within said second housing assembly which includes a movable member constructed and arranged to be moved between first and second positions, a rotatable impeller, structural surfaces for directing a continuous supply of water under pressure from the inlet end of said second housing assembly in jet formation onto said impeller to rotate the same, and a rotatable output member, the arrangement being such that when said movable member is in said first position said output member is connected to be rotated by the rotation of said impeller in one direction and when said movable member is in said second position said output member is connected to be rotated by the rotation of said impeller in an opposite direction, a planetary gear assembly mounted within said second housing assembly comprising a multiplicity of gears including coaxial sun and ring gears and carrier mounted planetary gears in meshing relation between coaxial sun and ring gears, one of said ring gears being a movable ring gear mounted within said second housing assembly to be moved arcuately about an axis thereof between first and second positions, said movable ring gear being connected with the movable member to move said movable member (1) from the first position thereof into the second position thereof when said movable ring gear is moved from the first position thereof to the second position thereof and (2) from the second position of said movable member into the first position thereof when said movable ring gear is moved from the second position thereof into the first position thereof, said multiplicity of gears including an input gear connected to be moved about the axis of said movable ring gear by the rotatable output member and an output gear movable about the axis of said ring gear and connected to move said sprinkler head assembly about the oscillating axis thereof in a direction corresponding to the direction of movement of said output gear, said adjusting mechanism including a stop system acting between said sprinkler head assembly and said second housing assembly constructed and arranged to determine first and second stopping positions for said sprinkler head assembly, the arrangement being such that said sprinkler head assembly is moved about the oscillating axis thereof (1) in a direction toward said first stopping position when said movable ring gear is retained in the first position thereof with said rotatable output member rotating in said one direction and said input and output gears moving in directions corresponding thereto so that when said sprinkler head assembly reaches said first stopping position the movement of the sprinkler head assembly is stopped while the continued rotation of the rotatable output member in said one direction and the corresponding movement of said input gear cause said ring gear to be moved about its axis from the first position thereof to the second position thereof and (2) in an opposite direction toward said second stopping position when said movable ring gear is retained in the second position thereof with said rotatable output member rotating in said opposite direction and said input and output gears moving in directions corresponding thereto so that when said sprinkler head assembly reaches said second stopping position the movement of the sprinkler head assembly and output gear is stopped while the continued rotation of the rotatable output member in said opposite direction and the corresponding movement of said input gear cause said movable ring gear to be moved about its axis from the second position thereof to the first position thereof.

9. A unitized sprinkler assembly as defined in claim 8 wherein said adjusting mechanism includes first and second side-by-side adjusting rings mounted on an annular housing section of said second housing assembly constructed and arranged to be moved into first and second selected adjustment positions within first and second ranges of adjustment positions, said first and second rings having first and second fixed stop surfaces thereon disposed in arcuately spaced relation to one another when said rings are in first and second selected adjustment positions, said sprinkler head assembly having cooperating first and second stop surfaces thereon disposed in a position to engage said fixed first and second stop surfaces at the end of each head stroke and return stroke of said sprinkler head assembly respectively, said first and second rings each being split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof, said annular housing section having a series of outwardly facing serrations on the exterior surface thereof of a size and shape to mesh with the plurality of serrations of said arcuate sections, said first and second rings each being constructed and arranged to be moved from any first or second selected adjustment position respectively to any other first or second selected adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of said annular housing section.

10. A unitized sprinkler assembly as defined in claim 1 wherein said adjusting mechanism includes first and second side-by-side adjusting rings mounted on an annular housing section of said second housing assembly constructed and arranged to be moved into first and second selected adjustment positions within first and second ranges of adjustment positions, said first and second rings having first and second fixed stop surfaces thereon disposed in arcuately spaced relation to one another when said rings are in first and second selected adjustment positions, said sprinkler head assembly having cooperating first and second stop surfaces thereon disposed in a position to engage said fixed first and second stop surfaces at the end of each head stroke and return stroke of said sprinkler head assembly respectively, said first and second rings each being split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof, said annular housing section having a series of outwardly facing serrations on the exterior surface thereof of a size and shape to mesh with the plurality of serrations of said arcuate sections, said first and second rings each being constructed and arranged to be moved from any first or second selected adjustment position respectively to any other first or second selected adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of said annular housing section.

11. A unitized sprinkler assembly as defined in claim 1 wherein said first and second housing assemblies are disposed in supported relation on said base assembly so that the inlet and outlet ends thereof extend generally in alignment with one another in a direction generally parallel to the ground area on which the base assembly supports said first and second housing assemblies with the oscillatory axis of said sprinkler head assembly extending generally in the same parallel direction, said sprinkler head assembly being constructed and arranged to discharge water under pressure flowing through the inlet end thereof in a fan-shaped multistream configuration.

12. A unitized sprinkler assembly as defined in claim 1 wherein said first housing assembly is supported on said base assembly so that the inlet and outlet ends thereof extend generally in alignment with one another in a direction generally parallel to the ground area on which the base assembly supports said first housing assembly, said second housing assembly being supported on said base assembly so that the inlet and outlet ends thereof are generally in alignment in a direction generally perpendicular to the ground area on which the base assembly supports said second housing assembly with the oscillatory axis of said sprinkler head assembly extending generally in the same perpendicular direction, said sprinkler head assembly being constructed and arranged to discharge water under pressure flowing through the inlet end thereof in a configuration which includes an upwardly and outwardly extending main stream.

13. A sprinkler assembly comprising a housing assembly including an inlet end constructed and arranged to be communicated with a source of water under pressure and a spaced outlet end, a sprinkler head assembly connected in water pressure communicating relation with said housing assembly outlet end constructed and arranged to discharge water under pressure received from said housing assembly outlet end in a predetermined stream configuration therefrom, said housing assembly including a peripheral wall portion extending axially between the inlet end and the outlet end of said housing assembly, said peripheral wall portion having a cam slot formed therein to extend from one end thereof peripherally to an opposite end thereof displaced axially from the one end thereof a distance substantially less than the peripheral distance between the ends thereof, said housing assembly inlet end communicating with an inlet cylindrical wall extending axially within an inlet end of said peripheral wall portion, said housing assembly outlet end communicating with an outlet cylindrical wall extending axially within an outlet end of said peripheral wall portion, a movable cylindrical wall having opposite end portions disposed in sealed telescoping relation with said inlet and outlet cylindrical walls, a handle fixed with respect to said movable cylindrical wall and extending within said cam slot outwardly thereof in a position to be manually engaged, said handle being constructed and arranged with respect to said cam slot to be guided axially by said cam slot when manually moved through a peripheral extent thereof so that the axial position of said handle within said cam slot determines the axial position of said movable cylindrical wall in telescoping relation with said input and output cylindrical walls, said movable cylindrical wall and one of said input and output cylindrical walls having cooperating flow control surfaces movable relatively axially toward and away from one another as said movable cylindrical wall is moved axially with the handle in response to a manual peripheral movement thereof, said cooperating flow control surfaces being constructed and arranged to vary the flow through said cylindrical walls in accordance with the position of said handle within said cam slot.

14. A sprinkler assembly as defined in claim 13 wherein a cylindrical wall portion concentric with said movable cylindrical wall extends outwardly from an inner end of said handle, said cylindrical wall portion having an exterior periphery disposed in sliding engagement with an interior periphery of said housing assembly, said peripheral wall portion having an extent sufficient to interiorly close said cam slot in any position of said handle.

15. A sprinkler assembly as defined in claim 14 wherein the interior periphery of said housing assembly peripheral wall portion is of a size to enable said handle, said movable cylindrical wall and said cylindrical wall portion to be moved axially through an open end thereof and then radially to extend said handle through said cam slot and engage the exterior periphery of said cylindrical wall portion with the interior periphery of said peripheral wall portion.

16. A sprinkler assembly as defined in claim 15 wherein the inlet end of said housing assembly includes an annular closure wall integral with said inlet cylindrical wall and a female hose coupling element rotatably connected with an inlet end of said inlet cylindrical wall, said annular closure wall having a periphery constructed and arranged to mate with the inlet end of said peripheral wall portion.

17. A sprinkler assembly as defined in claim 13 wherein the movable cylindrical wall has an annular support member fixed therein by a plurality of annularly spaced arms and a resilient flow control element fixedly mounted on said annular support member on which the flow control surface of said movable cylindrical wall is provided, said cam slot being of helical configuration with flat portions at an end thereof corresponding with a minimum zero flow.

18. A flow control assembly for use between a source of water under pressure and a sprinkler assembly, said flow control assembly including a housing assembly having an inlet end constructed and arranged to be connected with a source of water under pressure and a spaced outlet end constructed and arranged to be connected in water pressure communicating relation with a sprinkler assembly, said housing assembly including a peripheral wall portion extending axially between said inlet end and said outlet end having a cam slot formed therein to extend from one end thereof peripherally to an opposite end thereof displaced axially from the one end thereof a distance substantially less than the peripheral distance between the ends thereof, said housing assembly inlet end communicating with an inlet cylindrical wall extending axially within an inlet end of said peripheral wall portion, said housing assembly outlet end communicating with an outlet cylindrical wall extending axially within an outlet end of said peripheral wall portion, a movable cylindrical wall having opposite end portions disposed in sealed telescoping relation with said inlet and outlet cylindrical walls, a handle fixed with respect to said movable cylindrical wall and extending within said cam slot outwardly thereof in a position to be manually engaged, said handle being constructed and arranged with respect to said cam slot to be guided axially by said cam slot when manually moved through a peripheral extent thereof so that the axial position of said handle within said cam slot determines the axial position of said movable cylindrical wall in telescoping relation with said input and output cylindrical walls, said movable cylindrical wall and one of said input and output cylindrical walls having cooperating flow control surfaces movable relatively axially toward and away from one another as said movable cylindrical wall is moved axially with the handle in response to a manual peripheral movement thereof, said cooperating flow control surfaces being constructed and arranged to vary the flow through said cylindrical walls in accordance with the position of said handle within said cam slot.

19. A sprinkler assembly comprising a housing assembly having an inlet end constructed and arranged to be connected to a source of water under pressure and a spaced outlet end, a sprinkler head assembly connected in water-pressure communicating relation with the outlet end of said housing assembly constructed and arranged to discharge water under pressure therefrom in a predetermined stream configuration, a structural connection between the outlet end of said housing assembly and said sprinkler head assembly constructed and arranged to enable said sprinkler head assembly to be oscillated about an oscillatory axis with respect to said housing assembly, an oscillating mechanism carried by said housing assembly adjacent the outlet end thereof including an oscillating output member connected with said sprinkler head assembly constructed and arranged to move said sprinkler head assembly about said oscillatory axis through repeated oscillating head cycles during which water under pressure discharged from said sprinkler head assembly is distributed in a predetermined pattern on a ground area to be sprinkled, each of said oscillating head cycles including a head stroke in one direction and a return head stroke in the opposite direction so that a corresponding dimension of said water pattern corresponds with the distance of the head stroke of each head cycle, an adjusting mechanism constructed and arranged to enable the distance of the head stroke of each head cycle to be adjusted within a range between a minimum head stroke distance and a maximum head stroke distance so as to vary the corresponding dimension of said water pattern within a range between a minimum dimension and a maximum dimension, a water flow valve carried by said housing assembly adjacent the inlet end thereof constructed and arranged to be moved between (1) a closed position preventing the flow of water under pressure from the inlet end to the outlet end of said housing assembly and (2) an open position permitting the flow of water under pressure from the inlet end to the outlet end of said housing assembly, a valve-moving mechanism carried by said housing assembly constructed and arranged to be manually moved away from a valve-closing position into a selected watering position within a range of watering positions between a minimum watering position and a maximum watering position, said valve-moving mechanism being constructed and arranged with respect to said flow control valve to enable the flow control valve to be (1) in the closed position thereof when said valve-moving mechanism is in the valve-closing position thereof and (2) in the open position thereof when said valve-moving mechanism is within the range of watering positions thereof, a constant stroke producing mechanism carried by said housing assembly including (1) an oscillating input member connected with said oscillating output member to be moved thereby through repeated oscillating input cycles corresponding to the repeated oscillating head cycles said sprinkler head assembly is moved by said oscillating output member and (2) a constant stroke output member constructed and arranged to produce a movement stroke of a constant distance for each head cycle irrespective of the stroke distance with said range of stroke distances of each head cycle, and a motion-transmitting assembly carried by said housing assembly constructed and arranged to transmit the movement strokes of said constant stroke output member to said valve-moving mechanism to move said valve-moving mechanism from a selected watering position within said range of watering positions into said valve-closing position so that the amount of water delivered to the water pattern per unit area is determined by the selected watering position irrespective of the corresponding dimension of the pattern within said range of dimensions.

20. A sprinkler assembly as defined in claim 19 wherein said constant stroke-producing mechanism comprises an oscillation counting member having a lost motion connection with said oscillating input member to be moved through repeated oscillation counting cycles corresponding with said input cycles, the lost motion connection being constructed and arranged such that each oscillation counting cycle includes a counting stroke in one direction of a constant distance no greater than the input stroke distance corresponding with the minimum head stroke distance and a return counting stroke in the opposite direction, and said constant stroke output member having a one-way connection with said oscillating counting member constructed and arranged to move through a constant stroke during each cycle of said oscillation counting member.

21. A sprinkler assembly as defined in claim 20 wherein said housing assembly includes interior walls defining (1) a water-free cavity within a periphery of said housing assembly communicating with an opening in said periphery and (2) a water flow path communicating with said inlet and by-passing said cavity.

22. A sprinkler assembly as defined in claim 21 wherein said water flow valve comprises an inner valve member, an outer annular valve member having a valve seat for receiving said inner valve member and a lost motion connection between said inner and outer valve members allowing said inner valve member to be moved incrementally off of the valve seat of said outer annular valve member, said inner valve member including a valve stem slidably mounted in said housing assembly with one end thereof extending into said cavity in water-excluding relation and an opposite end formed with a valve head adapted to engage the valve seat of said outer annular valve member and communicating with water under pressure communicated with said inlet so as to be biased thereby (1) when said valve is in said open position toward the closed position thereof and (2) when in said closed position to remain in said closed position.

23. A sprinkler assembly as defined in claim 22 wherein said valve-moving mechanism comprises an annular member mounted in said cavity for movement about a rotational axis between the valve-closing position and range of watering positions, said annular member having a periphery extending within said peripheral opening so as to allow the periphery to be manually engaged to effect the manual movement of said annular member from said valve-closing position to a selected watering position within the range of watering positions, and a cam surface disposed in cooperating relation with the one end of said valve stem and constructed (1) to allow said valve member to be biased into the closed position thereof when said annular member is in said valve closing position and (2) to move and maintain said valve member into the open position thereof when said annular member is away from said valve-closing position.

24. A sprinkler assembly as defined in claim 23 wherein said motion-transmitting mechanism comprises a series of meshing gears including an input gear having teeth meshing with teeth formed on the output member of said constant stroke-producing mechanism and an output gear having teeth meshing with teeth formed on the annular member of said valve-moving mechanism.

25. A sprinkler assembly as defined in claim 24 wherein an interior wall defining said cavity has a ratchet element formed integrally thereon extending arcuately about the axis of rotation of said annular member, said annular member having an integral pawl formed thereon constructed and arranged to be self-biased to engage said ratchet element so as to prevent movement of said annular member about the rotational axis thereof in one direction while permitting ratcheting movement in an opposite direction, said output gear being connected to be rotated by a preceding gear in said series of meshing gears by a one-way ratcheting connection which transmits movement of the preceding gear to said output gear in a meshing direction to cause said output gear to move said annular member in said opposite direction while allowing manual movement of said annular member in said opposite direction to move said output gear in said meshing direction relative to said preceding gear.

26. A sprinkler assembly as defined in claim 19 wherein said valve moving mechanism is constructed and arranged to be moved into and out of an on position during the manual movement thereof away from said valve-closing position before reaching the range of watering positions, said valve moving mechanism being constructed and arranged to enable the flow control valve to be in the open position thereof when said valve moving mechanism is within said on position, said motion transmitting assembly being constructed and arranged to be out of motion transmitting relation with said valve moving mechanism when said valve moving mechanism is in the on position thereof.

27. A sprinkler assembly comprising a housing assembly having an inlet end constructed and arranged to be communicated with a supply of water under pressure and a spaced outlet end, a water jet and impeller reversing assembly within said housing assembly including a movable member constructed and arranged to be moved between first and second positions, a rotatable impeller, structural surfaces for directing a continuous supply of water under pressure from said inlet end in jet formation onto said impeller to rotate the same, and a rotatable output member, the arrangement being such that when said movable member is in said first position said output member is connected to be rotated by the rotation of said impeller in one direction and when said movable member is in said second position said output member is connected to be rotated by the rotation of said impeller in an opposite direction, a planetary gear assembly mounted within said housing assembly comprising a multiplicity of gears including coaxial sun and ring gears and carrier mounted planetary gears in meshing relation between coaxial sun and ring gears, one of said ring gears being a movable ring gear mounted within said housing assembly for arcuate movement about an axis thereof between first and second positions, said movable ring gear being connected with the movable member to move said movable member (1) from the first position thereof into the second position thereof when said movable ring gear is moved from the first position thereof to the second position thereof and (2) from the second position of said movable member into the first position thereof when said movable ring gear is moved from the second position thereof into the first position thereof, a sprinkler head assembly connected in water pressure communicating relation with the outlet end of said housing assembly constructed and arranged to discharge water under pressure in a predetermined stream configuration therefrom, a structural connection between the outlet end of said housing assembly and said sprinkler head assembly constructed and arranged to enable said sprinkler head assembly to be moved about an axis, said multiplicity of gears including an input gear connected to be moved about the axis of said movable ring gear by the rotatable output member and an output gear movable about the axis of said ring gear and connected to move said sprinkler head assembly about its axis in a direction corresponding to the direction of movement of said output gear, a stop system acting between said sprinkler head assembly and said housing assembly constructed and arranged to determine first and second stopping positions for said sprinkler head assembly, the arrangement being such that said sprinkler head assembly is moved about its axis (1) in a direction toward said first stopping position when said movable ring gear is retained in the first position thereof with said rotatable output member rotating in said one direction and said input and output gears moving in directions corresponding thereto so that when said sprinkler head assembly reaches said first stopping position the movement of the sprinkler head assembly is stopped while the continued rotation of the rotatable output member in said one direction and the corresponding movement of said input gear cause said movable ring gear to be moved about its axis from the first position thereof to the second position thereof and (2) in an opposite direction toward said second stopping position when said movable ring gear is retained in the second position thereof with said rotatable output member rotating in said opposite direction and said input and output gears moving in directions corresponding thereto so that when said sprinkler head assembly reaches said second stopping position the movement of the sprinkler head assembly and output gear is stopped while the continued rotation of the rotatable output member in said opposite direction and the corresponding movement of said input gear cause said movable ring gear to be moved about its axis from the second position thereof to the first position thereof.

28. A sprinkler assembly as defined in claim 27 wherein said water jet and impeller reversing assembly includes an end member having a water-confining surface exposed to the water under pressure flowing from said housing assembly inlet end, said structural surfaces including a fixed nozzle surface extending inwardly of said water-confining surface, and spaced first and second oppositely directed arcuate surfaces on a second movable member mounted adjacent said impeller for movement between (1) a first position wherein said first arcuate surface is aligned with said fixed nozzle surface to direct a jet formation issuing therefrom generally tangentially in one direction onto said impeller to rotate said impeller in the one direction and (2) a second position wherein said second arcuate surface is aligned with said fixed nozzle surface to direct a jet formation issuing therefrom generally tangentially in an opposite direction onto said impeller to rotate said impeller in the opposite direction.

29. A sprinkler assembly as defined in claim 28 wherein said first-mentioned movable member and said second movable member are mounted for relative oscillatory movements about a common oscillatory axis for movement between the first and second positions thereof and an overcenter spring is mounted between said first and second movable members, said overcenter spring being constructed and arranged to (1) bias said second movable member to remain in the first position thereof when said first movable member is in the first position thereof, (2) bias said second movable member from the first position thereof into the second position thereof when said first movable member is moved from the first position thereof into the second position thereof, (3) bias said second movable member to remain in the second position thereof when said first movable member is in the second position thereof and (4) bias the second movable member to move from the second position thereof into the first position thereof when said first movable member is moved from the second position thereof into the first position thereof.

30. A sprinkler assembly as defined in claim 29 wherein said first-mentioned movable member includes a series of annularly spaced axially extending teeth and said movable ring gear includes a plurality of annularly spaced arms extending axially therefrom having teeth thereon constructed and arranged to mesh with the teeth of said first movable member.

31. A sprinkler assembly as defined in claim 30 wherein another of said ring gears is fixed with respect to said second housing assembly.

32. A sprinkler assembly as defined in claim 31 wherein said end member also includes a by-pass opening extending from the water-confining surface thereof to an opposite surface thereof, and a thin member of molded plastic material fixed to the opposite surface of said end member providing a flap valve closing said by-pass opening operable to open said by-pass opening in response to the water reaching a predetermined pressure at the confining surface of said end member.

33. A sprinkler assembly as defined in claim 32 wherein said stop system comprises an arm fixed to said sprinkler head assembly to move therewith through an arcuate path and first and second side-by-side adjusting rings mounted on an annular housing section of said housing assembly constructed and arranged to be moved into first and second selected adjustment positions within first and second ranges of adjustment positions, said first ring having a first stop surface disposed within said arcuate path to be engaged by said arm to determine the first stopping position for said sprinkler head assembly in accordance with the first selected adjustment position of said first ring within the first range of adjustment positions, said second ring having a second stop surface disposed within said arcuate path to be engaged by said arm to determine the second stopping position for said sprinkler head assembly in accordance with the second selected adjustment position of said second ring within the second range of adjustment positions, said first and second rings each being split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof, said annular housing section having a series of outwardly facing serrations on the exterior surface thereof of a size and shape to mesh with the plurality of serrations of said arcuate sections, said first and second rings each being constructed and arranged to be moved from any first or second selected adjustment position respectively to any other first or second selected adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of said annular housing section.

34. A sprinkler assembly as defined in claim 27 wherein said stop system comprises an arm fixed to said sprinkler head assembly to move therewith through an arcuate path and first and second side-by-side adjusting rings mounted on an annular housing section of said housing assembly constructed and arranged to be moved into first and second selected adjustment positions within first and second ranges of adjustment positions, said first ring having a first stop surface disposed within said arcuate path to be engaged by said arm to determine the first stopping position for said sprinkler head assembly in accordance with the first selected adjustment position of said first ring within the first range of adjustment positions, said second ring having a second stop surface disposed within said arcuate path to be engaged by said arm to determine the second stopping position for said sprinkler head assembly in accordance with the second selected adjustment position of said second ring within the second range of adjustment positions.

35. A sprinkler assembly as defined in claim 34 wherein each of said first and second rings are split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof, said annular housing section having a series of outwardly facing serrations on the exterior surface thereof of a size and shape to mesh with the plurality of serrations of said arcuate sections, said first and second rings each being constructed and arranged to be moved from any selected first or second adjustment position respectively to any other selected first or second adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of said annular housing section.

36. A sprinkler assembly as defined in claim 35 wherein said first and second rings are of substantially identical configuration and mounted so as to be disposed in mirror image relation with one another.

37. A sprinkler assembly as defined in claim 36 wherein said first and second rings include interengaging movement limiting surfaces defining a limit to the least arcuate movement of said arm between first and second selected adjustment positions of said first and second rings to be approximately 30°.

38. A sprinkler assembly as defined in claim 34 wherein said oscillating output member has a shaft connected concentrically therewith which extends axially from said output member toward an inlet end portion of said housing assembly, the inlet end portion of said housing assembly having a manually adjustable control mechanism mounted therein and connected with said shaft constructed and arranged to determine a manually selected time water under pressure is communicated with and discharged from said sprinkler head assembly.

39. A sprinkler assembly as defined in claim 38 wherein said manually adjustable control mechanism comprises a water flow valve mounted thereon adjacent the inlet end thereof constructed and arranged to be moved between (1) a closed position preventing the flow of water under pressure from the inlet end of said housing assembly and (2) an open position permitting the flow of water under pressure from the inlet end to the outlet end of said housing assembly, a valve-moving mechanism carried by said first housing assembly constructed and arranged to be manually moved away from a valve-closing position into a selected watering position within a range of watering positions between a minimum watering position and a maximum watering position, said valve-moving mechanism being constructed and arranged with respect to said flow control valve to enable the flow control valve to be (1) in the closed position thereof when said valve-moving mechanism is in the valve-closing position thereof and (2) in the open position thereof when said valve-moving mechanism is within the range of watering positions thereof, a constant stroke producing mechanism carried by said housing assembly including an oscillating input member connected with said shaft to be moved thereby through repeated oscillating input cycles and a constant stroke output member constructed and arranged to produce a movement stroke of a constant distance for each oscillating input cycle irrespective of the distance said sprinkler head assembly moves between said first and second stopping positions, and a motion-transmitting assembly carried by said housing assembly constructed and arranged to transmit the movement strokes of said constant stroke output member to said valve-moving mechanism to move said valve-moving mechanism from a selected watering position within said range of watering positions into said valve-closing position so that the amount of water delivered is determined by the selected watering position irrespective of the distance said sprinkler head assembly moves between said first and second stopping positions.

40. A sprinkler assembly as defined in claim 34 wherein said housing assembly includes an axially extending peripheral wall portion having an inlet end adjacent the inlet end of said housing and a spaced outlet end spaced from the outlet end of said housing assembly, a cam slot formed in said peripheral wall portion to extend from one end thereof peripherally to an opposite end thereof displaced axially from the one end thereof a distance substantially less than the peripheral distance between the ends thereof, an inlet cylindrical wall communicating in water pressure relation with said housing assembly inlet end extending axially within said inlet end of said peripheral wall portion, an outlet cylindrical wall within said housing assembly extending axially within said outlet end of said peripheral wall portion, a movable cylindrical wall having opposite end portions disposed in sealed telescoping relation with said inlet and outlet cylindrical walls, a handle fixed with respect to said movable cylindrical wall and extending within said cam slot outwardly thereof in a position to be manually engaged, said handle being constructed and arranged with respect to said cam slot to be guided axially by said cam slot when manually moved through a peripheral extent thereof so that the axial position of said handle within said cam slot determines the axial position of said movable cylindrical wall in telescoping relation with said input and output cylindrical walls, said movable cylindrical wall and one of said input and output cylindrical walls having cooperating flow control surfaces movable relatively axially toward and away from one another as said movable cylindrical wall is moved axially with the handle in response to a manual peripheral movement thereof, said cooperating flow control surfaces being constructed and arranged to vary the flow through said cylindrical walls in accordance with the position of said handle within said cam slot.

41. A sprinkler assembly comprising a housing assembly having an inlet end constructed and arranged to be connected with a source of water under pressure and a spaced outlet end, a sprinkler head assembly mounted on said housing assembly in water-pressure communicating relation with said housing assembly outlet end constructed and arranged to discharge water under pressure therefrom in a predetermined stream configuration, a structural connection between said sprinkler head assembly and said second housing assembly constructed and arranged to enable said sprinkler head assembly to be moved about an oscillatory axis with respect to said housing assembly, an oscillating mechanism carried by said housing assembly constructed and arranged to be operable by the flow of water under pressure between the inlet end and outlet end of said housing assembly to move said sprinkler head assembly about said oscillating axis through repeated oscillating head cycles during which water under pressure discharged from said sprinkler head is distributed in a predetermined pattern on the ground, each of said oscillating head cycles including a head stroke in one direction and a return head stroke in the opposite direction so that a corresponding dimension of said water pattern corresponds with the distance of the head stroke of each head cycle, an adjusting mechanism constructed and arranged to enable the distance of the head stroke of each head cycle to be adjusted within a range between a minimum head stroke distance and a maximum head stroke distance so as to vary the corresponding dimension of said water pattern within a range between a minimum dimension and a maximum dimension, said adjusting mechanism including first and second side-by-side adjusting rings mounted on an annular housing section of said housing assembly constructed and arranged to be moved into first and second selected adjustment positions within first and second ranges of adjustment positions, said first and second rings having first and second fixed stop surfaces thereon disposed in arcuately spaced relation to one another when said rings are in first and second selected adjustment positions, said sprinkler head assembly having cooperating first and second stop surfaces thereon disposed in a position to engage said fixed first and second stop surfaces at the end of each head stroke and return stroke of said sprinkler head respectively, said first and second rings each being split so as to define a pair of side-by-side end portions having (1) a pair of pinching elements fixed thereto and extending outwardly therefrom so as to present oppositely facing digital engaging surfaces and (2) a pair of short arcuate sections having a plurality of inwardly facing serrations on the interior thereof, said annular housing section having a series of outwardly facing serrations on the exterior surface thereof of a size and shape to mesh with the plurality of serrations of said arcuate sections, said first and second ring each being constructed and arranged to be moved from any first or second selected adjustment position respectively to any other first or second selected adjustment position respectively within the first or second ranges of adjustment positions respectively by (1) digitally engaging the digital engaging surfaces of the associated pinching elements, (2) pinching the digital engaging surfaces toward one another to enlarge the interior circumference of the associated ring and displace the associated inwardly facing serrations with respect to the outwardly facing serrations of the annular housing section, (3) moving the associated ring from the one selected adjustment position arcuately in the appropriate direction into the other selected adjustment position while retaining the associated pinching elements in pinched relation and (4) releasing the associated pinching elements after the arcuate movement of the associated ring into the other selected adjustment position to engage the associated inwardly facing serrations in meshing relation with the engaged outwardly facing serrations of said annular housing section.

42. A sprinkler assembly as defined in claim 41 wherein said first and second rings are of substantially identical configuration and mounted so as to be disposed in mirror image relation with one another.

43. A sprinkler assembly as defined in claim 42 wherein said first and second rings include interengaging movement limiting surfaces defining a limit to the least arcuate movement of said sprinkler head assembly between the interengagement of stop surfaces to be approximately 30°.

44. A wave sprinkler assembly comprising:

a housing and base assembly providing a water inlet for communication with a source of water under pressure and an outlet communicating with said inlet, a tubular spray assembly mounted on said housing and base assembly for oscillatory movement with respect thereto, said tubular spray assembly having an inlet end disposed in sealed water communicating relation with said outlet so that an interior of said tubular spray assembly receives water under pressure from said outlet, a closed end and a series of longitudinally spaced water stream outlets between said inlet end and said closed end, an oscillating mechanism carried by said housing and base assembly constructed and arranged to be operable by water flowing between said water inlet and said outlet to oscillate said tubular spray assembly when said water inlet is communicated with a source of water under pressure, said tubular spray assembly including a hollow tubular member and an elongated strip of flexible material positioned inside the tubular member, the strip having a number of said series of longitudinally spaced water stream outlets extending therethrough, said tubular member including an elongated section having transverse opening-defining and interior strip-engaging surfaces thereon, said strip having an interior pressure responsive surface and an exterior mounting surface constructed and arranged so that when said strip is positioned inside said tubular member, the interior pressure responsive and exterior mounting surfaces of said strip are engaged respectively (1) by the water under pressure within the interior of said tubular spray assembly and (2) by an interior strip-engaging surface of said tubular member so that engagement of the water under pressure with the strip enhances engagement of the strip with the tubular member, each water stream outlet in said strip extending within an opening in said tubular member defined by an opening-defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground area to be sprinkled.

45. A wave sprinkler assembly as defined in claim 44 wherein said tubular spray assembly includes a second elongated strip of flexible material positioned within the tubular member, the strip having a number of said series of longitudinally spaced water stream outlets extending therethrough, said second strip having an interior pressure responsive surface and an exterior mounting surface constructed and arranged so that when said second strip is positioned inside said tubular member, the interior pressure responsive and exterior mounting surfaces of said second strip are engaged respectively (1) by the water under pressure within the interior of said tubular spray assembly and (2) by an interior strip-engaging surface of said tubular member so that engagement of the water under pressure with the strip enhances engagement of the strip with the tubular member, each water stream outlet in said second strip extending within an opening in said tubular member defined by an opening-defining surface of said tubular member so that water under pressure within the interior of said tubular spray assembly issues from said series of longitudinally spaced water stream outlets as a series of longitudinally spaced water streams which oscillate as the tubular spray assembly is oscillated to provide a desired sprinkler pattern on a ground area to be sprinkled.

46. A wave sprinkler assembly as defined in claim 45 wherein the number of water stream outlets in each of said strips constitutes half of the series of water stream outlets.

47. A wave sprinkler assembly as defined in claim 46 wherein said water stream outlets in each strip are arranged in adjacent pairs, each adjacent pair extends within a separate opening in said tubular member defined by a transverse opening-defining surface of said tubular member.

48. A wave sprinkler assembly as defined in claim 47 wherein the water stream outlets in each strip are inclined progressively less in a direction from the end of the series so as to form the series of water streams into a fan shaped spray.

49. A sprinkler assembly comprising:

a housing assembly having an inlet end constructed and arranged to be connected in fluid communication with a source of water under pressure and a spaced outlet end, a sprinkler head assembly having an inlet end disposed to receive water under pressure flowing from the outlet end of the housing assembly, a base assembly constructed and arranged to support the housing assembly and the sprinkler head assembly on an area to be sprinkled and having the housing assembly and the sprinkler head assembly disposed in supported relation thereon, a structural connection between the sprinkler head assembly and the housing assembly constructed and arranged to enable said sprinkler head assembly to oscillate about an oscillatory axis with respect to the housing assembly, an oscillating mechanism connected to the sprinkler head assembly and constructed and arranged to oscillate the sprinkler head assembly about the oscillatory axis through repeated oscillating head cycles, such that each oscillating head cycle includes a head stroke in one direction and a return head stroke in the opposite direction, said sprinkler head assembly being constructed and arranged to discharge water under pressure flowing through the inlet end thereof in a stream configuration so as to be distributed in a water pattern determined by the oscillating head cycle thereof, and a manually adjustable control mechanism carried by the housing assembly, the control mechanism being constructed and arranged to control the flow rate of water under pressure to the sprinkler head assembly in accordance with manual adjustment of the control mechanism.

50. A sprinkler assembly as defined in claim 49, wherein the housing assembly includes a peripheral wall portion extending axially between said inlet end and said outlet end, the control mechanism including a cam slot formed in the peripheral wall portion to extend from one end thereof peripherally to an opposite end thereof displaced axially from the one end thereof a distance substantially less than the peripheral distance between the ends thereof, an inlet cylindrical wall communicating in water pressure relation with the housing assembly inlet end, an outlet cylindrical wall communicating with the housing assembly outlet end, a movable cylindrical wall having opposite end portions disposed in sealed telescoping relation with said inlet and outlet cylindrical walls, a handle fixed with respect to said movable cylindrical wall and extending within the cam slot outwardly thereof in a position to be manually engaged, the handle being constructed and arranged with respect to the cam slot to be guided axially by the cam slot when manually moved through a peripheral extent thereof so that the axial position of the handle within the cam slot determines the axial position of the movable cylindrical wall in telescoping relation with the input and output cylindrical walls, the movable cylindrical wall and one of the input and output cylindrical walls having cooperating flow control surfaces movable relatively axially toward and away from one another as the movable cylindrical wall is moved axially with the handle in response to a manual peripheral movement thereof, the cooperating flow control surfaces being constructed and arranged to vary the flow from the inlet through the cylindrical walls to the outlet in accordance with the position of the handle within the cam slot.

51. A sprinkler assembly as defined in claim 49 further including an adjusting mechanism constructed and arranged to enable the distance of the head stroke of each oscillating head cycle to be adjusted within a range between a minimum head stroke distance and a maximum head stroke distance.

52. A sprinkler assembly as defined in claim 51 wherein the adjusting mechanism includes first and second side-by-side adjusting rings mounted on an annular housing section of the housing assembly constructed and arranged to be moved into first and second selected adjustment positions within first and second ranges of adjustment positions, the first and second rings having first and second stop surfaces thereon disposed in arcuately spaced relation to one another when the rings are in first and second selected adjustment positions, the sprinkler head assembly having cooperating first and second stop surfaces thereon disposed in a position to engage the first and second stop surfaces of the first and second rings at the end of each head stroke and return stroke of the sprinkler head assembly respectively.

53. A sprinkler assembly as defined in claim 49, wherein the sprinkler head assembly includes a hollow tubular member and an elongated strip of flexible material positioned inside the hollow tubular member, the strip having a series of longitudinally spaced water stream outlets extending therethrough.

54. A sprinkler assembly as defined in claim 49, wherein the sprinkler head assembly includes a hollow tubular member having a plurality of controllable water stream outlets extending therethrough, and a control member mounted on the tubular member for movement relative to the tubular member between a full width operating position and a width limiting position, the control member selectively obstructing fluid flow through a number of the controllable water stream outlets, the number of controllable water stream outlets obstructed by the control member being selected by the position of the control member.

* * * * *